United States Patent [19]

Bunnelle

[11] 4,077,671

[45] Mar. 7, 1978

[54] SUBTERRANEAN DRILLING AND SLURRY MINING METHOD

[75] Inventor: Philip R. Bunnelle, Santa Clara, Calif.

[73] Assignee: FMC Corporation, San Jose, Calif.

[21] Appl. No.: 785,141

[22] Filed: Apr. 6, 1977

Related U.S. Application Data

[62] Division of Ser. No. 704,277, Jul. 12, 1976.

[51] Int. Cl.[2] ..... E21C 45/00

[52] U.S. Cl. ..... 299/17; 175/67

[58] Field of Search ..... 175/67; 299/17

[56] References Cited

U.S. PATENT DOCUMENTS

| | | | |
|---|---|---|---|
| 3,155,177 | 11/1964 | Fly | 299/17 X |
| 3,316,985 | 5/1967 | Fly | 175/67 X |
| 3,730,592 | 5/1973 | Wenneborg et al. | 175/67 |
| 3,747,696 | 7/1973 | Wenneborg et al. | 175/67 X |

*Primary Examiner*—Ernest R. Purser

*Attorney, Agent, or Firm*—Frank Ianno; A. J. Moore; C. Tripp

[57] ABSTRACT

Method for subterranean slurry drilling and mining of granular ore, such as phosphates, with a combined drilling and mining apparatus. The apparatus for performing the method includes a tool string having a drilling head and mining head that are selectively interchangeable on its upper end for drilling into one or more ore strata to be mined and thereafter to remove ore from the strata as a slurry. The drill string includes a plurality of inner and outer pipe sections connected to a mining nozzle section, to an eductor pump section, and to a drill bit at its lower end. A drilling/mining liquid is directed through the tool string during both the drilling and mining modes of operation. During drilling, liquid is directed through a foot valve into the rotating bit to wash cuttings to the surface externally of the tool. During mining, the tool string is rotated, the foot valve is closed, and a mining nozzle is opened thereby causing liquid jetting from the mining nozzle to reduce the ore to a slurry. The slurry is pumped to the surface by liquid passing upwardly through the eductor pump and through the inner conduit. Without removing the apparatus from the hole, a hydraulic control system is actuated by hydraulic pressure equal to or less than system pressure for shifting the mining nozzle, the eductor nozzle, and the drill bit foot valve between a drilling mode and a mining mode thus enabling several different ore bearing strata to be mined.

In a modified form of the apparatus for performing the method of invention a plurality of vertically spaced mining nozzles are provided and each nozzle is aligned with a different ore strata. A hydraulic control system is provided for controlling the hydraulic components between their drilling and mining modes, and for opening and closing the mining nozzles independently of each other. The control system is responsive to pressure equal to or less than the system pressure.

17 Claims, 23 Drawing Figures

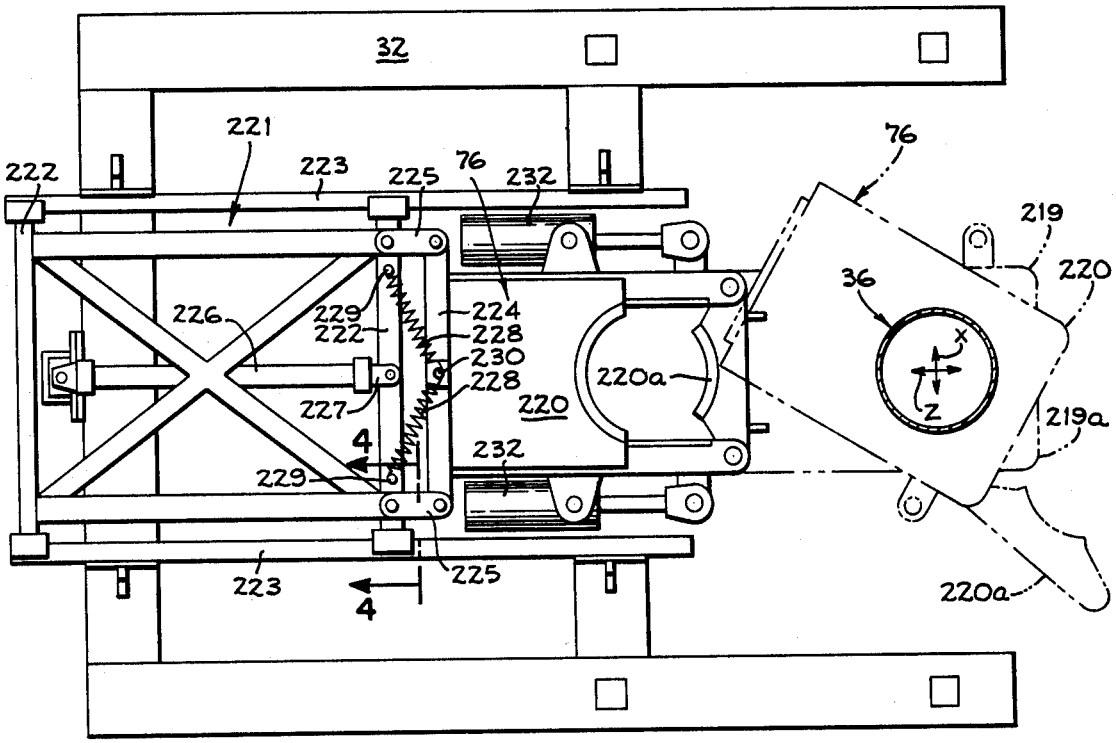
FIG_3
FIG_5
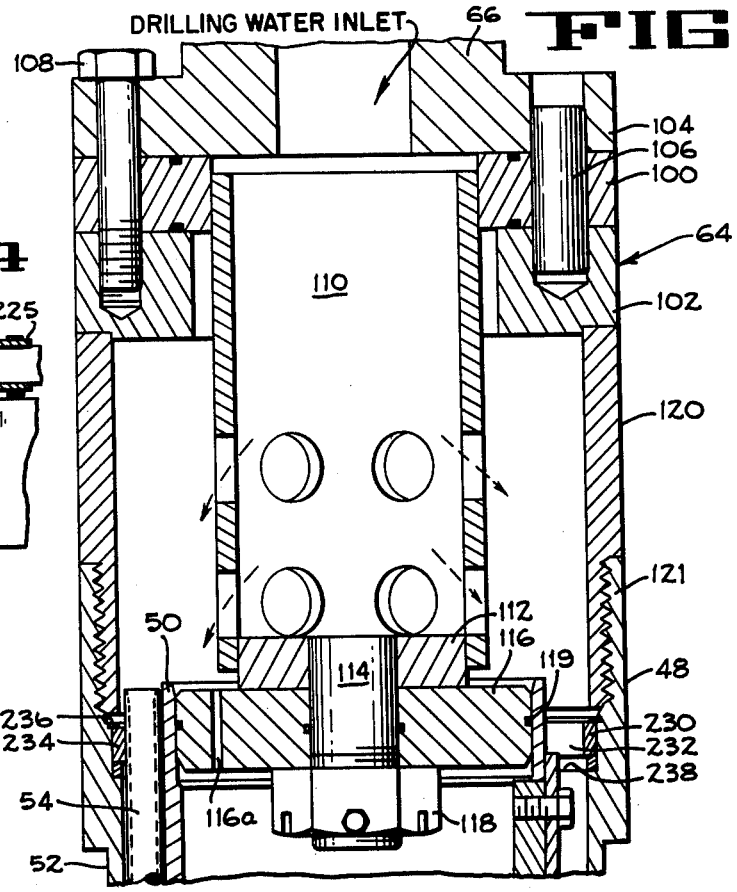
FIG_4
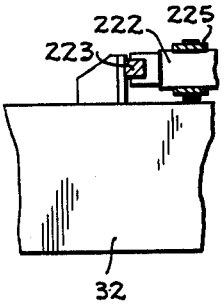

BOTTOM VIEW

SUBTERRANEAN DRILLING AND SLURRY MINING METHOD

This is a division, of application Ser. No. 704,277 filed July 12, 1976.

CROSS REFERENCE TO RELATED APPLICATION

My copending U.S. Pat. application Ser. No. 704,278, filed on even date herewith and assigned to the assignee of the present invention, discloses additional modified forms of the present invention.

BACKGROUND OF THE INVENTION

1. Field of the Invention

This invention pertains to improvement in subterranean slurry mining and more particularly relates to a method for drilling and mining one or more layers of granular ore, such as phosphates, without withdrawing the mining apparatus from the hole between the drilling and mining modes of operation.

2. Description of the Prior Art

Subterranean slurry mining of phosphates or the like is broadly known in the art as evidenced by U.S. Wenneborg et al Pat. Nos. 3,730,592 and 3,747,696 which issued on May 1, 1973 and July 24, 1973, respectively, and are assigned to the assignee of the present invention. The disclosures of both of these patents are incorporated by reference herein.

The modified embodiment of the device disclosed in Wenneborg et al U.S. Pat. No. 3,747,696 is the most pertinent prior art embodiment and comprises a combination slurry drilling and mining apparatus which may be changed between its drilling mode of operation and its mining mode of operation to mine several different layers of ore without requiring that the apparatus be pulled out of the hole or well. However, the hydraulic control system for changing the several valves from the drilling mode to the mining mode requires a positive pressure of about 2000 psig in the prior art device which is much greater than the approximately 1000 psig mining pressure. The prior art hydraulic control system thus requires additional high pressure pumping equipment, and is also subject to damage due to the very high control pressures and "water hammer" type forces which may be applied to the system.

Wenneborg et al U.S. Pat. No. 3,730,592 discloses a method which contemplates the use of surface controlled pressures equal to or in excess of the drilling pressure for shifting the mining nozzle, the eductor nozzle, and the drill bit foot valve between the drilling mode and the mining mode. In addition, the patentee discloses the use of control pressures which lie in a range between the drilling pressure and the mining pressure for modulating the mining nozzle. Modulation of the mining nozzle is effective to control the cavity pressure, and also the liquid level in the mined cavity to vary the mining conditions for the particular strata being mined.

U.S. parent and divisional Pat. Nos. 3,155,177 and 3,316,985 which issued to A. B. Fly on Nov. 3, 1964 and May 2, 1967, respectively, disclose a method and apparatus for under-reaming or slurry mining a well and can also be controlled to alternately bore deeper and mine other strata in the well after the first boring and mining operations have been completed. Valves operated by electric motors located within the tool string convert the apparatus from a drilling operation to a mining operation. The amount of force that can be applied to convert the apparatus from the drilling operation to the mining operation is, accordingly, limited by the size of the electric motors that can fit within the tool string.

SUMMARY OF THE INVENTION

In accordance with a first embodiment of the present invention a combined drilling and mining, method, is provided. The combined apparatus for performing the method comprises a double conduit tool string having a drill bit on its lower end, an eductor pump section and a mining nozzle section both of which are disposed within an ore bearing strata upon completion of the initial drilling operation, and a mining head connected through a swivel joint at the upper end of the tool string.

During drilling, a mining/drilling liquid (hereinafter referred to as water) is directed at about 300 psig (surface pressure) into a drilling head attached to a conventional vertically movable and rotatably driven power swivel. The water is directed through the outer annular conduit of the tool string and then passes through a tool bit foot valve into the tool bit. The water aids the drilling process and flushes the cuttings upwardly to the surface through the annular passage defined between the outer surface of the rotating tool string and the inner surface of the uncased drilled hole or well.

After the initial drilling has been completed, a mining head replaces the drilling head on the upper end of the pipe string and is connected thereto through a swivel joint to allow rotation of the tool string during mining. The mining head includes an inlet passage which enables the drilling/mining water to flow downwardly in the outer annular conduit of the tool string, and to allow a slurry of water and the granular ore being mined to flow upwardly through a generally cylindrical inner conduit in the tool string and out through a slurry outlet passage in the mining head for collection in any suitable collecting means such as a tank or pipeline to a processing plant.

A hydraulic control system is selectively controlled from the surface to maintain the drill bit foot valve open, the eductor pump nozzle closed and the mining nozzle closed during the drilling mode of operation; and to maintain the drill bit foot valve substantially closed, the eductor nozzle open, and the mining nozzle open during the mining mode of operation. An important feature of the invention is that the system pressure of the hydraulic control system and the drilling pressure are substantially the same (i.e., about 300 psig) during the drilling mode thus providing substantially no differential pressure in the two systems during drilling. During the mining mode the mining pressure is about 700–1000 psig surface pressure and the control pressure is vented to the atmosphere and accordingly, is at substantially 0 psig when it is desired to maintain the mining nozzle and the eductor nozzle fully open and maintain the drill bit foot valve substantially closed. The mining nozzle and eductor nozzle are both spring urged toward the closed position. The spring force acting on the eductor nozzle is such that a supply or start-up system pressure of about 60 psig will overcome the spring force causing the eductor nozzle to open and the foot valve to close. Since the cavity pressure below the closed foot valve is low, the system pressure acting on the large upper surface of the foot valve holds the foot valve closed (and the eductor nozzle open) even if the control pressure and system pressure are both increased to mining pressure. A start up pressure of about 100 psig will overcome the spring force controlling the mining nozzle and will cause the mining nozzle to open. If desired the mining nozzle may be closed during mining by applying mining pressure to the control system.

After the granular ore has been depleted from the mined matrix, the mining head is removed and the associated springs open the foot valve and close the mining and eductor nozzles thus returning the apparatus to its drilling mode. The hole or well cavity may then be drilled deeper, and additional pipe sections are then assembled in the tool string until the mining nozzle and slurry inlet are located in another ore matrix at which time the mining head is replaced and the control system is bled to return the nozzle plugs and foot valve to their mining positions. The new matrix is then mined and thereafter additional matrixes at different levels may be mined by alternately drilling deeper and mining the ore bearing matrixes disposed opposite the mining nozzle and eductor pump inlet at the different levels. It is also understood that the tool may first be drilled down to its lowest level, and can then alternatively be raised to higher levels as it mines the several ore bearing matrixes.

In a second embodiment of the invention a plurality of mining nozzles are assembled in the tool string and are vertically spaced apart distances equal to the spacing of a plurality of ore bearing matrixes desired to be mined. With this embodiment of the invention, a plurality of levels, for example two levels, may be mined without changing the elevation of the mining apparatus or requiring that the apparatus be changed from its mining mode to its drilling mode and back to its mining mode in order to mine the two levels. In a system having two mining nozzles, the lower matrix may be mined first so that ore from the upper matrix, which is separated from the lower matrix by a layer of overburden, will partially collapse into the lower matrix and will be drawn through the slurry inlet of the eductor pump at the lower level.

The two mining nozzle system is especially advantageous when mining an upper ore matrix which includes considerable clay mixed with the ore and accordingly is difficult to reduce to a slurry; and a lower matrix which includes less clay and accordingly is more easily reduced to a slurry. In this example, the upper mining nozzle may be smaller than the lower mining nozzle so that the division of water during mining between the upper mining nozzle and the eductor nozzle is such that the water passing through the eductor nozzle will lower or "draw down" the water level in the upper matrix below the jet of water passing through the small capacity upper nozzle. Thus, the jet from the upper nozzle passes through air, not water, and therefore more effectively reduces the ore to a slurry. The lower mining nozzle may have a much larger flow capacity and accordingly provide less water to the eductor nozzle resulting in a lower pumping capacity. Thus, the cavities from which ore has been removed may be completely filled with water thereby preventing collapse of the upper walls of the cavity, or rupture of the floor of the cavity due to underground water pressure. If the area being mined has high subterranean water pressure as indicated in the above example, it is preferable that the upper strata be mined before the lower strata.

A modified hydraulic control system is provided for the apparatus having two or more mining nozzles therein, but operates in the same manner and with substantially the same control pressures used in the first embodiment. The modified control system includes additional valve means which will cause a selected one of the mining nozzles to be opened during mining while the other mining nozzle (or nozzles) are closed.

Another modified control system is provided which is self-activated by detecting the pressure differential between the system pressure and the pressure in the well cavity for selectively opening and closing the nozzle without the aid of control lines to the surface.

It is therefore one object of the present invention to provide a method of hydraulically controlling a combined drilling and mining apparatus that is effective to: maintain certain hydraulically operated components in their drilling mode when the control pressure is about the drilling pressure; maintain the components in their mining mode when the control pressure is bled off; control the selective opening or closing of the mining nozzle by varying the control pressure during mining; and sense the cavity pressure below the drill foot valve within an environment of clean flowing water.

Another object of the invention is to provide a method using a combined drilling and mining apparatus having a pair of vertically spaced nozzles for mining ore bearing strata at different levels, and a hydraulic control system for such apparatus capable of controlling the components in the manner above described, and additionally capable of selectively opening either mining nozzle while the other mining nozzle is held closed.

Another object of the invention is to provide a method using a ratchet type drive for rotating the tool string during mining which allows the longitudinal axis of the string to freely shift laterally a limited amount in all directions thus minimizing the possibility of applying high bending loads on the tool string and preventing damage to the outer drive surface of the tool string by repeated frictional gripping of the same by conventional drive means.

Another object is to provide a method using a mining head that is adapted to receive a hoist supported hydraulic power swivel and drilling head used for rotating the tool string during drilling for first screwing the mining head and its swivel joint on the upper end of the tool string, and for thereafter supporting the tool string during mining including the option of raising the string during mining thereby causing the jet of liquid discharged from the mining nozzle to contact the ore matrix at different levels making it possible to more effectively mine unusually deep matrixes.

Another object is to provide a method using a mining nozzle having fluid straightening vanes for guiding a coaxial mining nozzle piston-plug between nozzle closing and opening positions, and which nozzle is easily assembled and disassembled from the tool string for maintenance and repair.

Another object is to provide a method using a pivotally mounted eductor nozzle plug for minimizing side loading and binding forces from occurring as the plug enters and is withdrawn from the eductor nozzle orifice.

Another object is to provide a method using a drill bit foot valve plug which is mounted on a piston rod for limited amounts of lateral movement to permit accurate alignment with and sealing upon the seat of the foot valve.

BRIEF DESCRIPTION OF THE DRAWINGS

FIG. 3 is a top plan view illustrating a mechanism for supporting the torque wrench while allowing a small amount of relative movement between the barge and the tool string.

FIG. 4 is a section taken along lines 4—4 of FIG. 3.

FIG. 5 is a vertical section taken through a drilling head which is screwed into the upper end of each pipe section, in turn, as the well is being drilled; and is thereafter screwed into the top of the mining head for supporting the apparatus during mining, said view further illustrating the details of the upper end of standard pipe sections of the tool string.

DESCRIPTION OF THE PREFERRED EMBODIMENT

Figure 1:
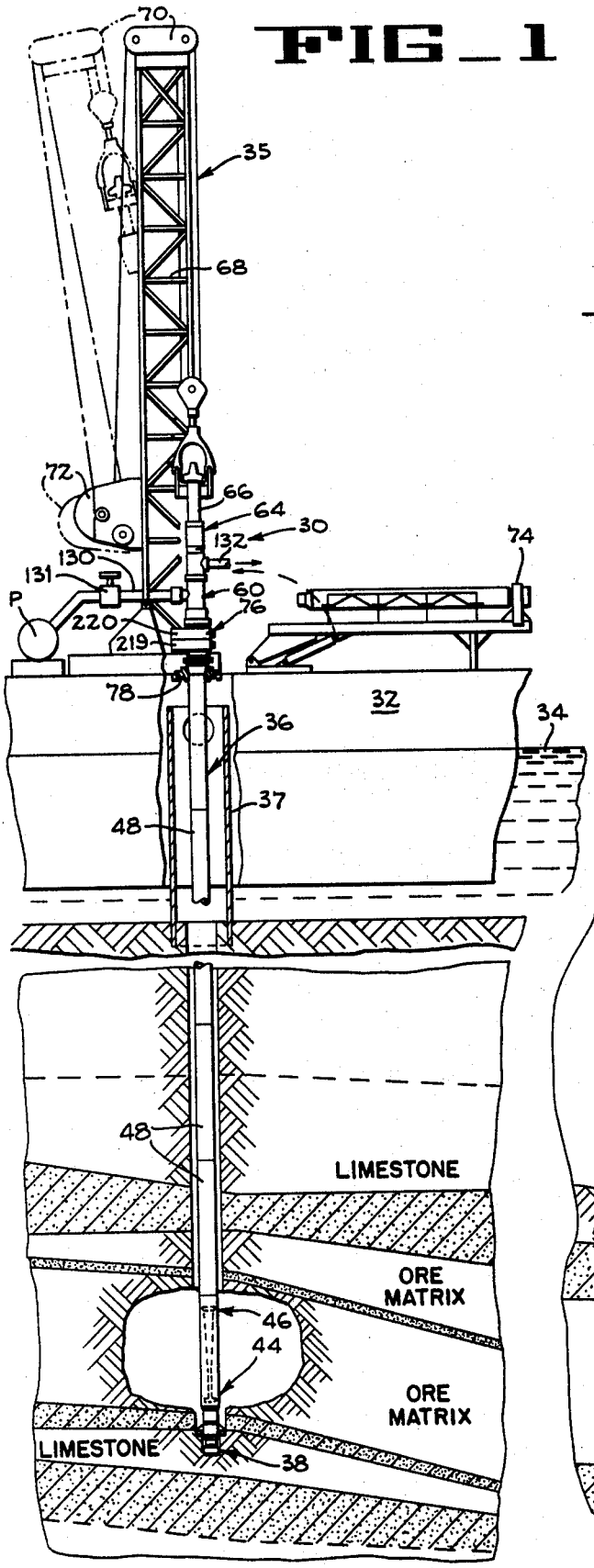
FIG. 1 is a diagrammatic elevation of one embodiment of the drilling and mining apparatus used in performing the method of the present invention shown supported from a barge and illustrated in its mining mode in a multi-stratum ore bed with one level being mined, several sections of the tool string being cut away to greatly foreshorten the height of the Figure.

The subterranean slurry drilling and mining apparatus 30 (FIG. 1) for performing the method of the present invention is supported on a mobile vehicle such as a barge 32 floating in a pond 34 over the mining site. Conventional components of a well drilling rig 35 on the barge are employed during the drilling mode of operation to assemble the mining and drilling apparatus 30 section-by-section. Prior to drilling the rig 35 is used to drive a large diameter conductor pipe 37 into the floor of the pond 34 to prevent the water in the pond from flowing into the well cavity. The apparatus is then operated in its mining mode to remove and collect a slurry of liquid and ore from the matrix being mined. After the reclaimable granular ore has been mined from one or more ore matrixes at the mining site, the apparatus is pulled from the well and is disassembled enabling the barge to move to another site.

Although the apparatus 30 is primarily intended for use in mining phosphates from one or more ore strata at depths between about 200 and 300 feet below the surface, it will be understood that the apparatus may be used at other depths for mining other types of ore including nonmetallic material. It will also be understood that the term "ore" as used herein includes gravel, rocks, or any other solids that the apparatus is capable of slurry pumping to the surface. It will also be understood that the apparatus is capable of handling ore as large as four inches in diameter although the normal consistency of the phosphate ore is somewhat like sand.

Figure 19:
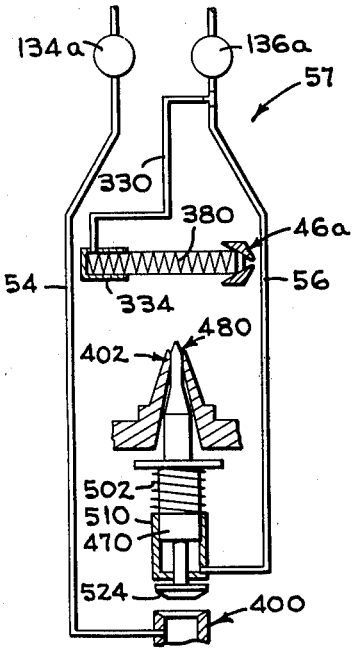
FIG. 19 is a schematic diagram illustrating a hydraulic circuit which includes control lines leading to the surface for controlling the opening and closing of the mining nozzle, the eductor nozzle, and the foot valve and also for detecting the cavity pressure.

In general, the first embodiment of the drilling and mining apparatus 30, when fully assembled in its mining mode, includes a tool string 36 that extends downwardly through the conductor pipe 37 and has a conventional rotary drill bit assembly 38 at its lower end. It will be understood that the bit 38 includes lower cutters 40 and side cutters or underreamers 42 that cooperate to bore a hole or well cavity that is somewhat larger in diameter than the tool string. The side cutters 42 are pivoted inwardly when the tool is being pulled to the surface after the ore has been depleted from the mining site. An eductor pump section 44 is connected to the upper end of the drill bit 38, and the mining nozzle section 46 which includes a mining nozzle 46*a*, is connected to the upper end of the eductor section 44. A plurality of dual string pipe sections 48 (FIG. 1) are connected together and to the mining nozzle section 46 and extend upwardly to the surface. Each pipe section 48 includes an inner string conduit section 50 (FIG. 2) defining a tubular passage, an outer string conduit section 52 which with the inner section 50 defines an outer annular passage, a cavity pressure sensing control line or conduit 54, and a control line 56 which with the fluid pressure within the conduit 50,52 define a hydraulic control system 57 (FIG. 19). The upper end of the uppermost pipe section 48 is connected to a swivel joint 58 that forms a portion of a mining head 60. The mining head 60 includes a threaded tool support coupling 62 that receives and is supported by a threaded swivel sub-assembly or drilling head 64.

The drilling head 64 is supported by a hydraulically driven power swivel 66 (FIG. 1) of the well rig 35. The power swivel 66 is guided for vertical movement along the frame 68 of a drilling mast 70 and is raised and lowered by a power driven 100 ton cable hoist 72. The power swivel 66 and the hoist 72 are used to support the tool string 36 during the mining mode of operation and also for raising (or lowering) the tool string a limited amount while mining, if desired, in order to change the vertical location of a jet of water discharged from the mining nozzle for more effectively breaking up the granular ore matrix.

The drilling head 64 and power swivel 66 are also used as a unit to screw each section of the tool string 36 together and to direct water downwardly through the outer conduit 52 and through the drill bit during the drilling mode. Similarly, the drilling head and power swivel unit is used to unscrew the pipe sections of the tool string 36 from each other when the apparatus is being pulled from the well. During the drilling and pulling modes, a well known drill loading unit 74, torque wrench 76, and tool slip 78 cooperate with the power swivel 66 in a manner well known in the art to perform the drilling and pulling functions. It will also be noted that the mast 70 is pivotally connected to the barge 32 and may be pivoted away from the well as indicated in dotted lines to permit driving the conductor pipe 37 into the upper layer of soil prior to drilling.

In order to better appreciate the several features of the first embodiment of the drilling and mining apparatus of the present invention, the components of the apparatus will be described in detail in the order in which they appear in the apparatus from top to bottom.

DRILLING HEAD

As mentioned above, the drilling head 64 (FIG. 2) is screwed into the mining head 60 for supporting the apparatus 30 during mining, and is also screwed into each section of the tool string 36 during drilling to screw the several sections together and to direct water through the outer annular conduit 52 and into and through the drill bit 38 during the drilling operation.

The drilling head 64 (FIG. 5) includes an inner string flange 100 and an outer string flange 102 rigidly secured to an annular flange 104 of the power swivel 66 by a pair of centering pins 106 and cooperating cap screws 108. A water distribution tube 110 secured to the flange 100 is perforated to direct water laterally outward, and has its lower end closed by a disc 112 and a downwardly projecting threaded stub shaft 114. An annular plug 116 is rotatably mounted on the stub shaft 114 and is held in place by a cooperating lock nut 118. The plug 116 is inserted into each inner string conduit section 50 of the tool string during the drilling operation to prevent water from entering the inner tubular passage of the string except through a small bleed hole 116*a* provided in the plug 116 for establishing a small downward flow of water that will purge debris therefrom. 0-rings or similar fluid seals 119 are positioned between mating parts to prevent leakage of water therepast when at its drilling pressure of about 300 psig.

An outer hardened pipe section 120 is welded to the outer flange 102 and has an externally threaded lower end which is threaded into the box end 121 of each outer pipe section 48 during the drilling operation. During assembly and disassembly of the several sections of the tool string 36, relatively moveable upper and lower pipe gripping jaws of the torque wrench 76 (FIG. 1) firmly grip the outer surface of the pipe section 120 and the associated box end 121, respectively, to aid the power swivel 66 in tightly connecting (or disconnecting) the several sections of the tool string together. As will become more apparent hereinafter, the inner conduit sections 50 (FIG. 5) of the several interconnected sections of the tool string 36 remain stationary while the outer sections 52 rotate when each outer section is being screwed into or out of the next lower section. The stub shaft 114 of the drilling head is also rotated when screwing the outer sections into or out of the next lower section. Thus, the rotatable mounting of the plug 116 relative to the stub shaft 114 prevents relative motion and possible galling between the outer periphery of the plug 116 and the inner annular sealing surface of the box ends of each inner conduit 50.

MINING HEAD 60

The mining head 60 (FIG. 6) is used during the mining mode and at that time is disposed below the crane supported power swivel 66 and drilling head 64, and above the rotatable tool string 36 to permit the tool string 36 to rotate while the upper portion of the mining head is held from rotation. The head 60 (FIG. 6) includes a water inlet conduit 130 (FIG. 1) connected to outer conduit 52 supplied by a pump P and controlled by a valve 131; a slurry outlet elbow 132 coupled with inner conduit 50; and two control line outlets 134 (only one outlet being shown in FIG. 6) connected to control lines 54 and 56, all of the above conduits being in fluid sealed relationship relative to each other. The control line outlets each include a three way valve 134*a* and 136*a* (FIG. 19). The control line valve 134*a* may be selectively controlled to connect the control lines 54 to a source of high pressure air for determining well cavity pressure, or to a position venting the control line 54 to the atmosphere. The valve 136*a* may be selectively controlled to either vent control line 56 to the atmosphere or to connect the line 56 to the system pressure of water supply line 130.

Figures 6, 6A:
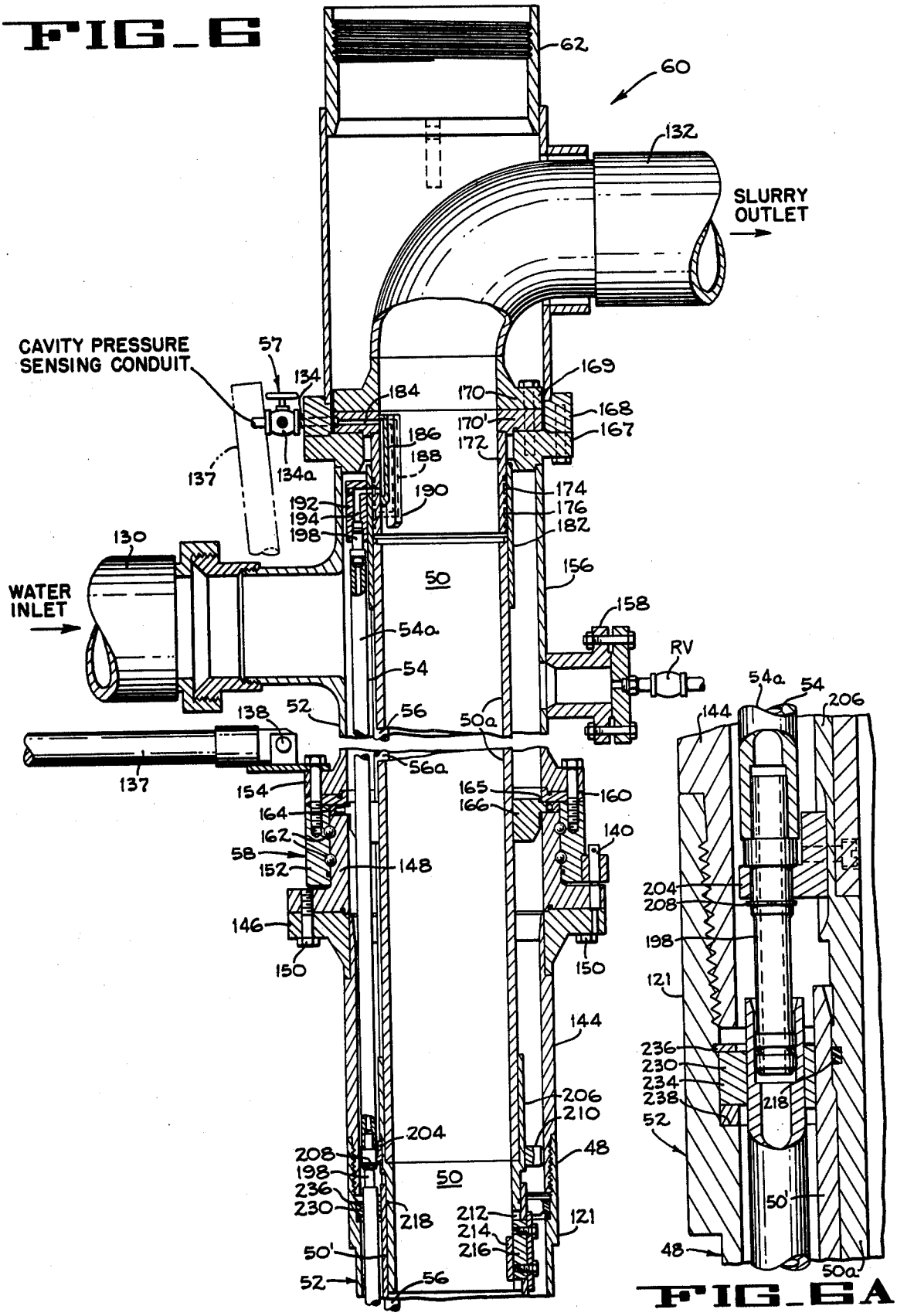
FIG. 6 is an enlarged vertical central section taken through the mining head of the apparatus of FIGS. 1 and 2 illustrating its specific details of construction.
FIG. 6A is an enlarged sectional view of a portion of a pipe section joint illustrating structure for centering the inner and outer pipe strings and for coupling the control lines.

The swivel joint 58 (FIG. 6) of the mining head 60 permits rotation of the tool string during mining while the outer portion of the head above the swivel joint is held from rotation by a torque arm 137 pivotally connected to the head by a pin 138 for movement between the solid line and dotted line positions in FIG. 6. Prior to the mining operation, the swivel joint 58 and upper portion of the head are locked from relative rotation by a shear pin 140 thus permitting the mining head to be screwed onto the uppermost pipe section by means of the power swivel 66 and drilling head 64 as previously described.

The mining head 60 includes a hardened pipe sleeve 144 which is screwed into the box end 121 of the outer conduit 52 of the uppermost pipe section 48 and may be engaged by the pivotal clamp jaws or dies of the torque wrench 76 (FIG. 1) (or by other drive mechanisms to be described hereinafter) to rotate the tool string in approximately 15° increments each five minutes during mining.

The sleeve 144 is welded to a pipe flange 146 that is connected to the flanged inner ball race 148 of the swivel joint 58 by capscrews 150. The outer ball race 152 is connected to the lower flange 154 of a pipe tee 156 by cap screws with an annular swivel ring bushing 160 sandwiched therebetween. In order to support the upper section 50*a* of the inner string 50 from axial movement relative to the outer string 52 and to seal the balls 162 of the swivel joint from the mining liquid, an annular chevron type seal 164 and the flange or lugs 165 of a collar 166 welded to the inner string 50 are rotatably received between the swivel ring 160 and the upper edge of the inner ball race 148.

Figure 2:
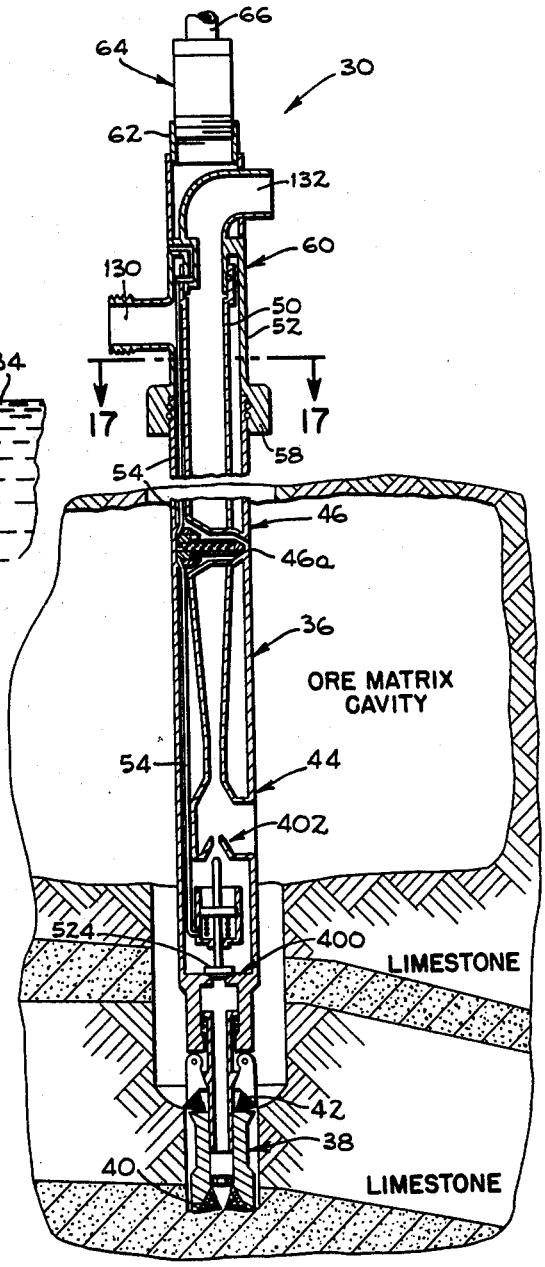
FIG. 2 is a diagrammatic vertical central section taken at a larger scale illustrating the several components of the tool string at a larger scale, several sections of the tool string being cut away to reduce its illustrated height.

The large pipe tee 156 which includes the water inlet conduit 130 also includes a flanged connector 158 to which a relief valve (or rupture disc) RV is connected. A flange 167 at the upper end of the pipe tee 156 is rigidly connected by cap screws to the flange 168 of the previously referred to threaded tool support coupling 62 which receives the tool supporting drilling head 64 (FIG. 2). A flange 169 (FIG. 6) on the slurry outlet elbow 132 is connected by capscrews to the flange 167, and has a ported annular flange 170' of an inner string and control line gland 170 clamped therebetween in fluid tight engagement. The gland 170 includes an inner sleeve 172 having an upper annular control system groove 174 and a lower annular control groove 176 along with three annular seal ring grooves formed in its outer periphery. Suitable well known seal rings are placed in the seal ring grooves to seal against the inner surface of a sleeve 182 rigid with a portion of the inner string section 50*a* thereby sealing the control system grooves 174 and 176 in fluid tight engagement from each other and from the inlet water and outlet slurry passages in the apparatus.

Cavity pressure sensing line outlet 134 of control line 54 communicates with the upper control system groove 174 through passage 184. A portion of the passage 184 is formed in a block 186 welded in fluid tight engagement to the inner surface of the sleeve 172. Similarly, the nozzle control line outlet of control line 56 communicates with the lower control system groove 176 through passages 188 (shown in dotted lines in FIG. 6), a portion of which is formed in a long block 190 welded to the inner surface of the sleeve 172.

A control line connector block 192 is welded to the outer surface of the sleeve 182 and includes flow passage 194 which communicates with the passage 184. The upper male end of the upper section 54*a* of the cavity pressure control or sensing line 54 is received in the passage 194 during assembly of the mining head 60 to define a bayonet type or stab connector 198 which is maintained in fluid tight engagement by an 0-ring.

Similarly, a block (not shown) which is identical to the block 192 is welded to the sleeve 182 and establishes a communication between the passage 188 and the upper section of the nozzle control line 56. The upper section of the nozzle control line includes a male end portion of a bayonet connector similar to connector 192 which is stabbed in fluid tight engagement with its mating female portion.

Like the upper ends, the lower end portions of the control line sections 54*a* and 56*a* are both connected to the next lower section of control lines 54 and 56 by bayonet type connectors 198 (FIGS. 6 and 6A). The lower ends are accurately positioned relative to the inner pipe string 50 by apertured brackets 204 (only one being shown) rigidly secured to a flanged sleeve 206 that forms the male end of the inner pipe section 50*a*. The lower or male end of each control line 54 and 56 are held from axial displacement relative to the brackets 204 by large diameter portions of the control lines 54 and 56 and cooperating snap rings 208. The lower end of the inner string section 50*a* is maintained in coaxial alignment with the outer string 52 by a plurality (preferably three) of equally spaced ears 210 welded to the sleeve 206 and slidably engaging the inner surface of the sleeve 144 of the outer string.

The lower end of the inner sleeve 206 is provided with a slot 212 (FIG. 6) having a strengthening strap 214 welded across its inner surface. A key 216 bolted to the upper end of the inner section 50' of the next lower pipe section is received in the slot 212 thus preventing rotation between the two inner sections. An 0-ring 218 seals the two inner pipe sections 50*a* and 50' together in fluid tight relationship.

TORQUE WRENCH 76

The torque wrench 76 is of standard design, identified as Varco Torque Wrench 250 manufactured by Varco International, Inc., 800 North Eckhoff Street, Orange, California 92668, and accordingly the details of the wrench will not be described. It will suffice to say that the torque wrench includes a lower gripping assembly 219 (FIGS. 1 and 3) and an upper gripping assembly 220 both of which include pivotal gates 219*a*, and 220*a* which gates may be pivotally opened to receive the tool string and thereafter independently closed into frictional clamping engagement with the several sections of the tool string 36. After being positioned around the tool string, the upper gripping assembly 220 may be pivoted through an angle up to about 27° relative to the non-rotatable lower gripping assembly 219 to either tighten or unscrew the several sections of the tool string 36 from each other, or to intermittently rotate the tool string 36 during mining.

Although the details of the torque wrench per se are not critical to the present invention, the structure for mounting the torque wrench on the barge 32 does form a part of the invention since it provides means of relieving bending forces on the tool string due to relative movement between the barge 32 and the tool string 36. In this regard, the barge, although anchored, tends to drift small amounts relative to the tool string 36, and also tends to roll about the longitudinal axis of the barge and pitch to a lesser extent about the transverse axis of the barge.

Having reference to FIG. 1, it will be apparent that the drill bit 38 at the lower end of the tool string 36 is held at the bottom of the drill hole from any substantial transverse movement and that the drill head 64 and power swivel 66 determines the position of the upper end of the string since the power swivel is slidably guided by the frame 68 of the mast 70. Thus, rolling, pitching or lateral movement of the barge 32 relative to the drill hole or well will cause the upper portion of the tool string 36 to move laterally relative to the torque wrench 76 if the torque wrench is rigidly secured to the barge 32. Although the transverse movement relative to a fixed torque wrench would be only a few inches, the bending force is applied to the tool string between its upper and lower ends become dangerously high unless the torque wrench 76 is permitted to freely center itself relative to the longitudinal axis of the tool string 36.

Accordingly, the torque wrench 76 is supported by a carriage 221 (FIG. 3) having U-shaped end portions of transverse beams 222 slidably received on slide bars 223 (FIGS. 3 and 4) that are rigidly supported on the barge 32 and extend longitudinally thereof. A cross-beam 224 rigid with the lower gripping assembly 219 is pivotally connected to the carriage 221 by parallel links 225. One end of a carriage advancing hydraulic cylinder 226 is pivotally connected to the barge frame while its piston rod 227 is pivotally connected to one of the transverse beams 222. Springs 228 are connected between pins 229 on the beam 222 and a pin 230 on the cross bar 224 to center the torque wrench 76 when the wrench is not in engagement with the tool string 36. Thus, the cylinder 226 when activated moves the torque wrench 76 between the solid line position (FIG. 3) at which time the wrench is in an inoperative position spaced from the tool string 36, and the operative tool engaging position illustrated in dotted lines with the upper gripping assembly 220 being shown in a pivoted position relative to the lower assembly 219.

After the torque wrench 76 has been clamped around the tool string 36, the valve (not shown) controlling the hydraulic cylinder 226 is placed in a neutral position permitting free movement of the piston rod 227. The parallel pivot links 225 will accommodate transverse misalignment of the tool string 36 and torque wrench 76 clamped thereon relative to the barge in the direction indicated by arrows X (FIG. 3). The freedom of movement of the piston rod 227 within the cylinder 226 accommodates longitudinal misalignment of the tool string 36 and torque wrench 76 relative to the barge 32 in the direction indicated by arrow Z (FIG. 3). Thus, the structure for supporting the torque wrench permits the torque wrench to perform its several functions without applying a bending force on the tool string 36 due to misalignment between the barge 32 and the tool string 36.

As mentioned above, the upper gripping assembly 220 may be pivoted through an angle of 27° (or any smaller angle) in either direction relative to the lower gripping assembly 219 by hydraulic cylinders 232. Other hydraulic cylinders (not shown) in each assembly are independently activated to alternately clamp and release the threaded joints between the several tool sections when the sections are being screwed together or are being unscrewed. When the torque wrench 76 is being used to intermittently index the tool string 36 during mining, the lower assembly is loosely received around the string and the jaws of the tool slip 78 are released from gripping engagement with the tool string. The upper gripping assembly 220 is clamped in gripping engagement with and rotates the tool string about 15° in about 5 seconds and is then loosened for approximately 5 minutes at which time it is again clamped to repeat the cycle of operation. It will be understood, however, that the tool string 36 may be rotatably indexed through different angular ranges for different time intervals if desired.

As indicated previously in the general description of the illustrated embodiment of the invention, the drilling head 64 (FIG. 1), which head is connected to the power swivel 66 and is supported by the hoist 72, is used without the mining head 60 when coupling and uncoupling several sections of the tool string 36 together; and is used with the mining head during mining. During drilling the power swivel provides the power to rotate the tool string 36, and during mining the torque wrench 76 provides the driving means for rotating the tool string 36.

It will be understood, however, that if desired, the drilling head and mining head may be combined as a unit and used during drilling as well as during mining. When used in this fashion, the power swivel 66 serves only to suspend the tool string 36, and all rotative power is provided by drive means such as the torque wrench 76 or the drive means illustrated in the second embodiment of the invention described in Wenneborg et al U.S. Pat. No. 3,730,592. As previously mentioned, this Wenneborg et al patent is assigned to the assignee of the present invention and is incorporated by reference herein. During drilling, the tool string should be driven at a rate of about 50–60 rpm; and during mining the tool string may be driven either continuously or intermittently but preferably at a much slower speed.

DUAL STRING PIPE SECTIONS 48

Since the mining nozzle section 46 and the eductor pump section 44 must be aligned with the particular ore strata being mined, and since the mining occurs between the 200 and 300 foot levels, the plurality of pipe sections 48 (FIG. 1) are not all the same length but are made in sections which vary in length between 10 feet and 20 feet. Thus, the length of the pipe sections 48 may be preselected and assembled together so as to provide a total length which will properly locate the mining nozzle **46*a* and the inlet of the eductor pump section 44** in the matrix being mined.

Although the inner string and outer string portions of the mining nozzle section 46 and the eductor nozzle section 44 are rigidly secured together as will be made apparent hereinafter, it will be understood that the outer section 52 of each standard pipe section 48 is rotated relative to both its inner section 50 and the two control lines 54 and 56 during assembly or disassembly of the tool string 36. Such relative rotation between the inner and outer sections permits the outer sections 52 to be interconnected by screw threads, which when compared to flanged connections is a much faster and less expensive method of connecting pipe sections together, while the several inner pipe sections 50 and the control lines 54 and 56 are coupled together by stab-type connections.

For ease in handling each dual string pipe section 48, the upper end of the inner section 50 is held in axial alignment with, and from axial displacement relative to, the outer section 52 by conventional means which includes a ring 230 (FIGS. 5 and 6A). The ring 230 is rigidly secured to the inner section 50 by a plurality of radial ears 232 (only one being shown in FIG. 5) and include a pair of apertures portions 234 (only one being shown), for slidably receiving and accurately locating the upper end of the associated sections of the control lines 54 and 56. The ring 230 is rotatably received in the outer section 52 and is held from axial displacement relative thereto between a snap ring 236 secured to the outer section and a thrust bushing held by a shoulder 238 formed in the outer section.

The lower end of each pipe section 50 is centered relative to the outer section 52, and the control lines 54 and 56 are held in place by ears and brackets similar to the ears 210 and the brackets 204 (FIG. 6). It will be apparent that the act of screwing the outer sections together will also cause the inner sections to move axially toward and into sealing relationship with each other. Thus, the joints between each dual pipe section 48 is the same as the joint between the sleeve 144 (FIG. 6) and the adjacent lower pipe section 48.

MINING NOZZLE SECTION 46

The mining nozzle section 46 (FIGS. 7–11), after being lowered to its initial mining position, is positioned in the ore matrix to be mined and includes the nozzle 46*a* which is closed during drilling and disassembly but is normally opened during mining. During mining a high velocity jet of water that is between about 1 ½ to 2 ¼ inches in diameter is directed into the matrix to break up the matrix into a slurry which is pumped to the surface by the eductor pump section 44 therebelow.

The mining nozzle section 46 differs from the previously described sections of the tool string 36 in that the inner string section 50*b* is rigidly secured to the outer string conduit section 52*b* prior to being screwed into the tool string 36.

The inner string section 50*b* includes an upper male or box end which is similar to the box end portion of the several pipe sections 48 (FIG. 6) previously described. Two equally spaced ears 300 (FIGS. 7 and 9) are welded to the outer surface of the box end to center the inner string section 50*b* with the outer string section 52*b*. The ears 300 slidably engage the inner surface of the upper box end 121*b* of the outer string section 52*b*, thus permitting assembly of the tube string sections. The upper inner box end is welded to a pipe section 302 having a fabricated outwardly bowed portion 304 (FIGS. 8 and 10) to permit large articles having a diameter up to about 5 inches to be moved upwardly through the inner tube 50*b* past a nozzle tube 306 that is welded transversely across the lower portion of the inner string of the mining nozzle section 46. A small diameter tube 308 is welded across the inner pipe section 302 below the nozzle tube and serves as means for accurately locking the inner section to the outer section as will be described in more detail hereinafter.

Since the inner string section 50*b* must rotate with the outer section 52*b* when the outer string section 52*b* is screwed into the eductor section 44 therebelow, the lower end of the pipe section 302 defines the inner portion of a second inner string and gland 312 that is similar to the gland 170 (FIG. 6). The gland 312 includes an upper annular control passage 314, a lower annular control passage 316, and 0-ring grooves formed in its outer periphery. 0-rings 318 in the 0-ring grooves engage the inner surface of the upper box end of the inner string 50*b* of the eductor section 44 to seal the control passages 314 and 316 from each other and from the mining water as well as the slurry being pumped to the surface.

Figure 7:
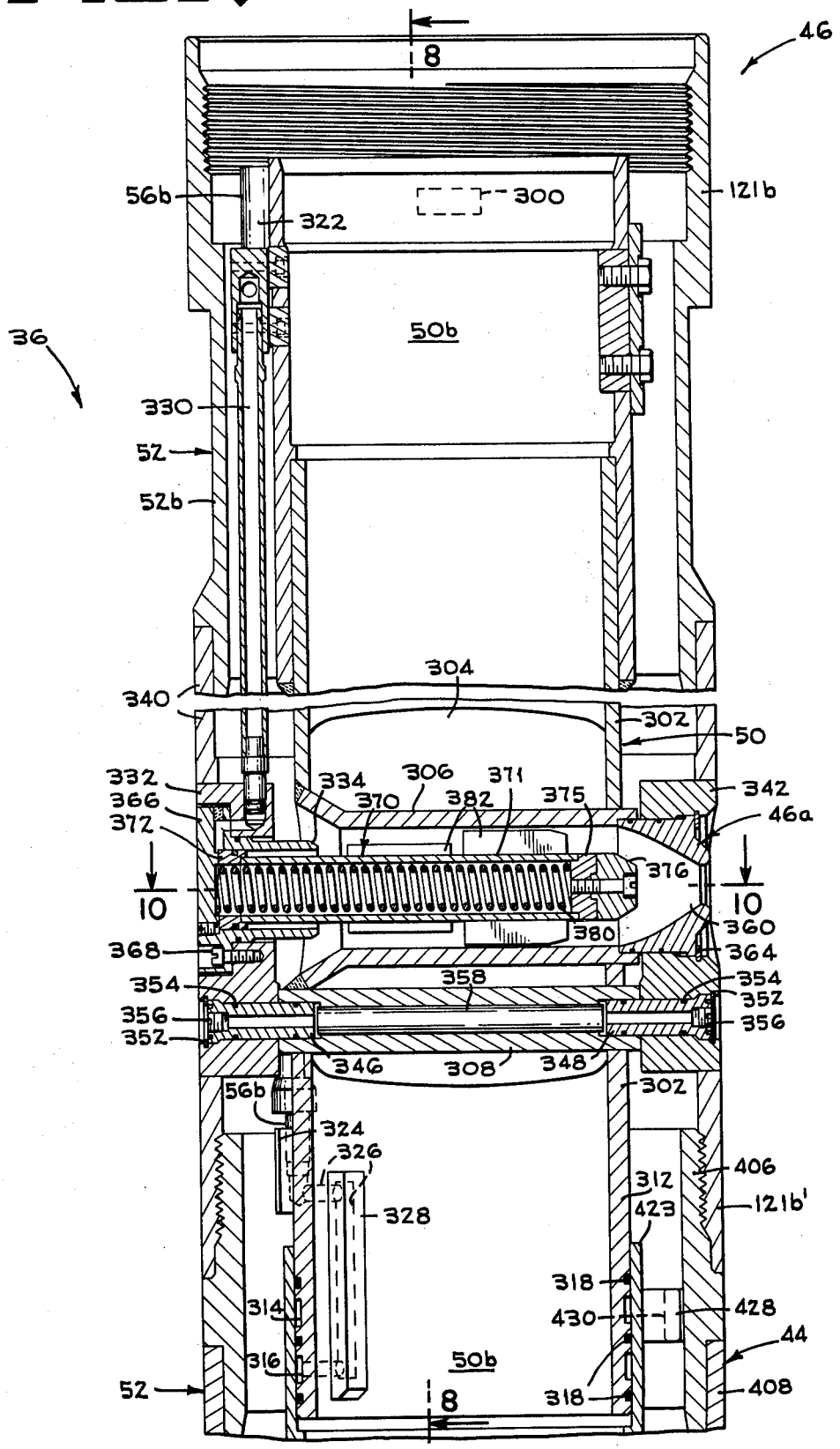
FIG. 7 is an enlarged vertical section taken along lines 7—7 of FIG. 9 through the mining nozzle section of FIGS. 1 and 2 with the mining nozzle plug being shown in the open mining position, certain parts being cut away.

Sections 54*b* and 56*b* (FIGS. 8 and 9) of the control lines 54 and 56 are connected in fluid tight flow communication with the sections of the control lines immediately thereabove by bayonet type connectors 320 and 322 bolted to the box end of the inner conduit section 50*b*. The lower end of the control line section 56*b* is connected to the upper end of a bayonet type connector 324 (FIGS. 8 and 11) secured to the outer surface of the pipe section 302. Flow passages 326 (FIGS. 7 and 11) are formed in the connector 324 in the pipe section 302 and in a hollow box 328 welded to the inner surface of the pipe section 302 to allow control fluid to flow between the line 56*b* and the annular passage 316 in the gland 312. A flow passage 329 (FIG. 8) similar to passage 326 connects the annular passage 314 to control line section 54*b*. In addition to the above control lines, a nozzle actuating branch line 330 is connected to control line 56*b* by passages in the adapter 322 and in a generally oblong cylinder supporting block 332 communicating with a cylinder 334 (FIG. 7).

The outer string section 52*b* comprises internally threaded upper and lower box ends 121*b* and 121*b*′ with the lower end 121*b*′ defining a portion of an intermediate pipe section 340. A generally oblong nozzle supporting block 342 and the cylinder supporting block 332 are welded to and seal holes formed in opposite walls of the box end 121*b*′. The blocks 332 and 342 (FIG. 7) and the end portions of the tube 308 are concentrically bored to receive tubular pins 346 and 348 which accurately position and lock the inner conduit section 50*b* to the outer conduit section 52*b*. The pins are held in place by snap rings 352 fitted in grooves in the blocks 332 and 342. O-rings 354 and plugs 356 screwed into threaded portions of the pins 346 and 348 prevent water from entering the tube 308 when it is desired to disassemble the inner string section 50*b* from the outer string section 52*b*, the plug 356 on at least one of the pins is unscrewed, and the snap rings 352 are removed. The pins are either pulled out by a bolt (not shown) threaded into the pin, or by inserting a rod through the tubular pins and then hammering the other pin out with the aid of a loose rod 358 placed in the tube 308 for that purpose.

The mining nozzle 46*a* includes an apertured nozzle seat 360 (FIGS. 9 and 10) which is sealed in a large diameter bore in the nozzle block 342 and in the adjacent end of the nozzle tube 306 by O-rings and a snap ring 364. The connection between the nozzle tube 306 and the nozzle seat 360 also serve to hold the inner conduit section 50*b* to the outer conduit section 52*b*. A bore in the cylinder supporting block 332 is formed concentrically with the nozzle seat 360 and has an end plate 366, which includes the aforementioned nozzle cylinder 334, connected therein by capscrews 368. The outer surface of the nozzle cylinder 334 is sealed to the block 332 by an O-ring with the cylinder being concentric with the nozzle seat 360.

Figure 8:
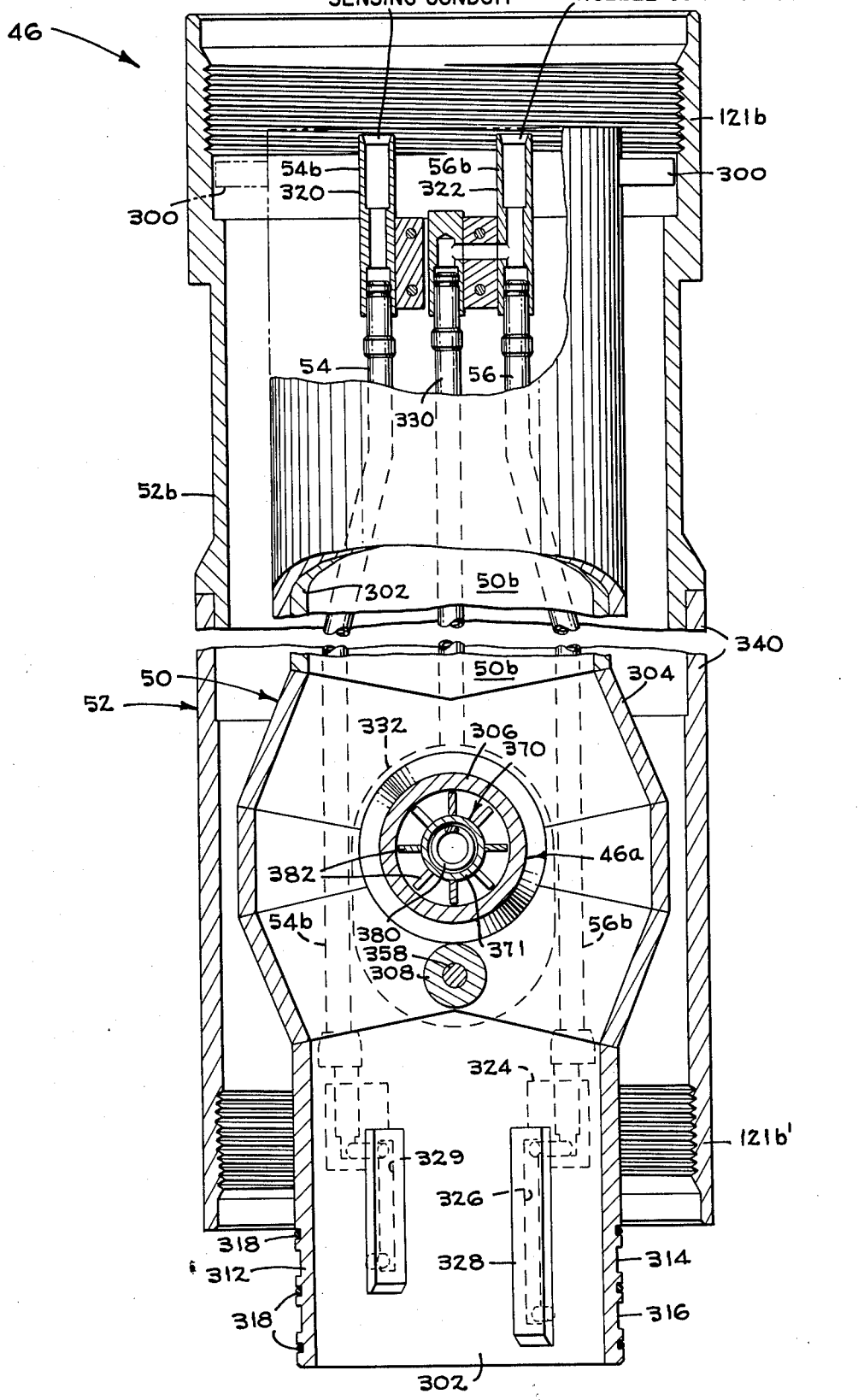
FIG. 8 is an elevation with parts in section taken generally along lines 8—8 of FIG. 7.
Figure 9:
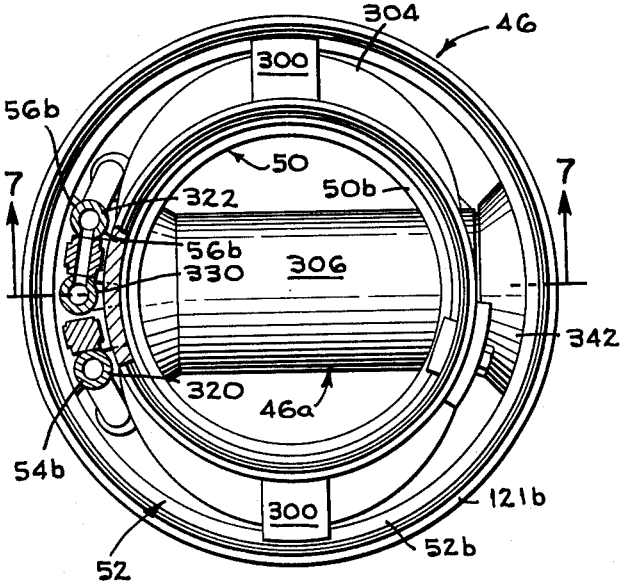
FIG. 9 is a top plan of the apparatus illustrated in FIG. 7, certain parts being cut away.
Figure 10:
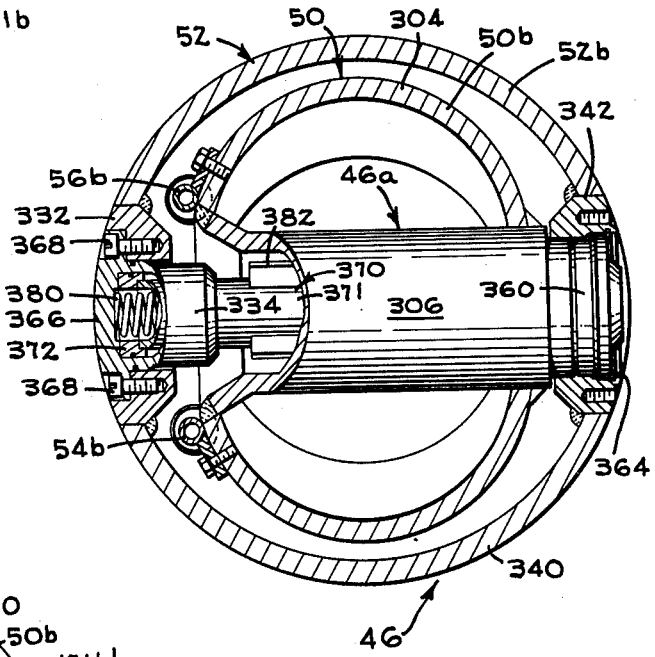
FIG. 10 is a horizontal section taken along lines 10—10 of FIG. 7.
Figure 11:
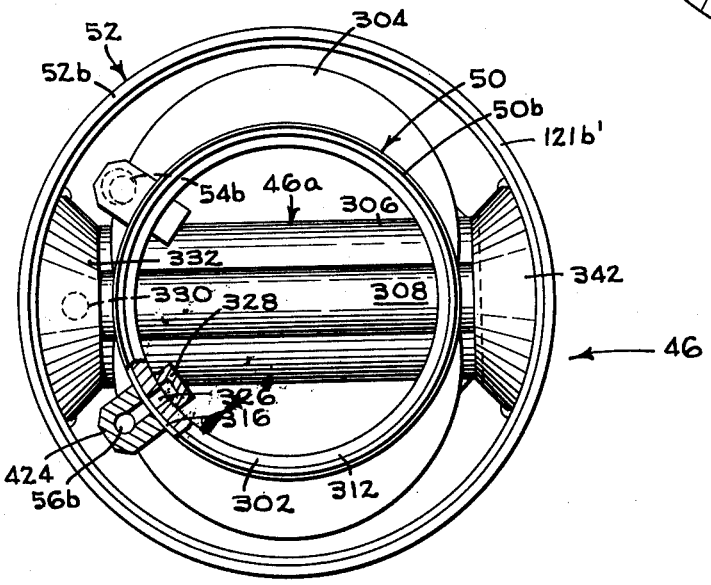
FIG. 11 is a bottom view of the mining nozzle section illustrated in FIG. 7 prior to being screwed into the next lower section which is the eductor section, a portion of one control line being cut away.

An elongate combined piston and nozzle plug unit 370 of the mining nozzle 46*a* includes a tubular body 371 and a piston 372 with an O-ring seal slidably received in the cylinder 334. The other end of the unit 370 is closed by a disc 375 having a nozzle plug 376 connected thereto by a capscrew so that the plug can easily be replaced when worn. The piston and nozzle plug unit 370 is urged into the nozzle closing position by a spring 380 disposed within the tubular body 371 and applies closing pressure between the end plate 366 and the disc 375 of the body 371. As illustrated in FIG. 8, the piston-nozzle plug unit 370 is guided during its opening and closing movement by a plurality of evenly spaced guide or straightening vanes 382 that are rigidly secured to the unit 370.

When the mining nozzle section 46 is not subjected to any substantial liquid pressure, for example, during assembly or disassembly of the several sections of the tool string, the spring 380 will maintain the nozzle closed. When drilling, drilling liquid enters and passes through the mining nozzle section 46 at about 300 psig (surface pressure) in the annular passage defined between the outer string 52*b* and the inner string 50*b*. Although an unbalanced pressure of about 100 psig acting on the outer surfaces of the piston and nozzle plug unit 370 is sufficient to overcome the string pressure and open the nozzle 46*a*, the approximate 300 psig mining or system pressure is overbalanced when liquid at the same pressure is directed into the nozzle cylinder 334 through control lines 56, 56*b* and branch line 330. This additional "overbalanced" closing force aids the spring 380 to maintain the nozzle closed during drilling.

This "overbalancing" force occurs when the mining nozzle 46*a* is closed because the system pressure within the cylinder 334 tending to close the nozzle plug unit 370 acts on the full piston area, while system pressure exerting a force in the opposite direction on the nozzle plug unit 370 acts on the full piston area less that portion of the piston area that is subjected only to cavity pressure. As will be apparent, when the mining nozzle is closed an area that is approximately equal to the area of the aperture in the mining nozzle seat will be subjected only to the very low cavity pressure.

An important feature of the invention is that this "overbalanced" force acting on the piston and plug unit 370 during drilling greatly resists any force tending to open the mining nozzle. Such external forces may occur during mining in the uncased well cavity because the nozzle plug unit 370 may be contacted by rocks or the like, or by accumulations of cuttings that are being forced upwardly between the rotating tool string and the walls of the well cavity. If the mining nozzle is permitted to be opened by such accumulations, the cuttings may plug the water flow passages in the nozzle 46*a* thus rendering the entire apparatus ineffective to perform its mining function.

During mining the control lines 56, 56*b* and 330, and accordingly the cylinder 334 are vented to the atmosphere by valves 136*a* (FIG. 19). Pump P (FIG. 1) on the barge 32 then directs mining water through the mining nozzle section at about 700 to 1000 psig which is more than ample to open the mining nozzle to the position illustrated in FIG. 7 thereby directing a high pressure and high velocity jet of water into the ore matrix being mined. However, because of water hammer shock problems which would result if the nozzle was opened at full mining pressure, the initial mining start up pressure is greatly reduced by a valve 131 (FIG. 1) in the main water supply line at the surface so that the mining nozzle 46*a* will open when the pressure is relatively low, for example about 100psig. As the nozzle begins to open, an additional area of the nozzle plug 376 is exposed to opening pressure thus overcoming the spring rate and tending to open the nozzle with a snap action force which occurs to some extent even at low pressures. The rate of opening of the nozzle 46*a* is controlled by friction loses within the control passages which restrict the upward flow in the control line 56, 56*b* and 330. Also further restriction may be provided if desired by means of the manually controlled valve 136*a* (FIG. 19) at the surface.

If desired, the mining nozzle 46*a* can be closed during mining by applying mining flow pressure to the control line 56. However, to minimize water hammer effect, the mining pressure should momentarily be reduced prior to closing the mining nozzle by either reducing both the pressure and the capacity of the pump P (FIG. 1), or by partially closing the valve 131.

EDUCTOR PUMP SECTION 44

The eductor pump section 44 (FIGS. 12–16) is connected between the mining nozzle section 46 and the drill bit 38. This section includes a foot valve 400 leading to the drill bit 38 which is open during drilling and closed during mining. An eductor nozzle 402 is also included in the section 44 and is closed during drilling and open during mining to draw the ore slurry into the tool string 36 and to thereafter propel the slurry upwardly to the surface through the inner string 50 with the aid of a venturi tube 404 which is part of the inner string 50.

Figure 12:
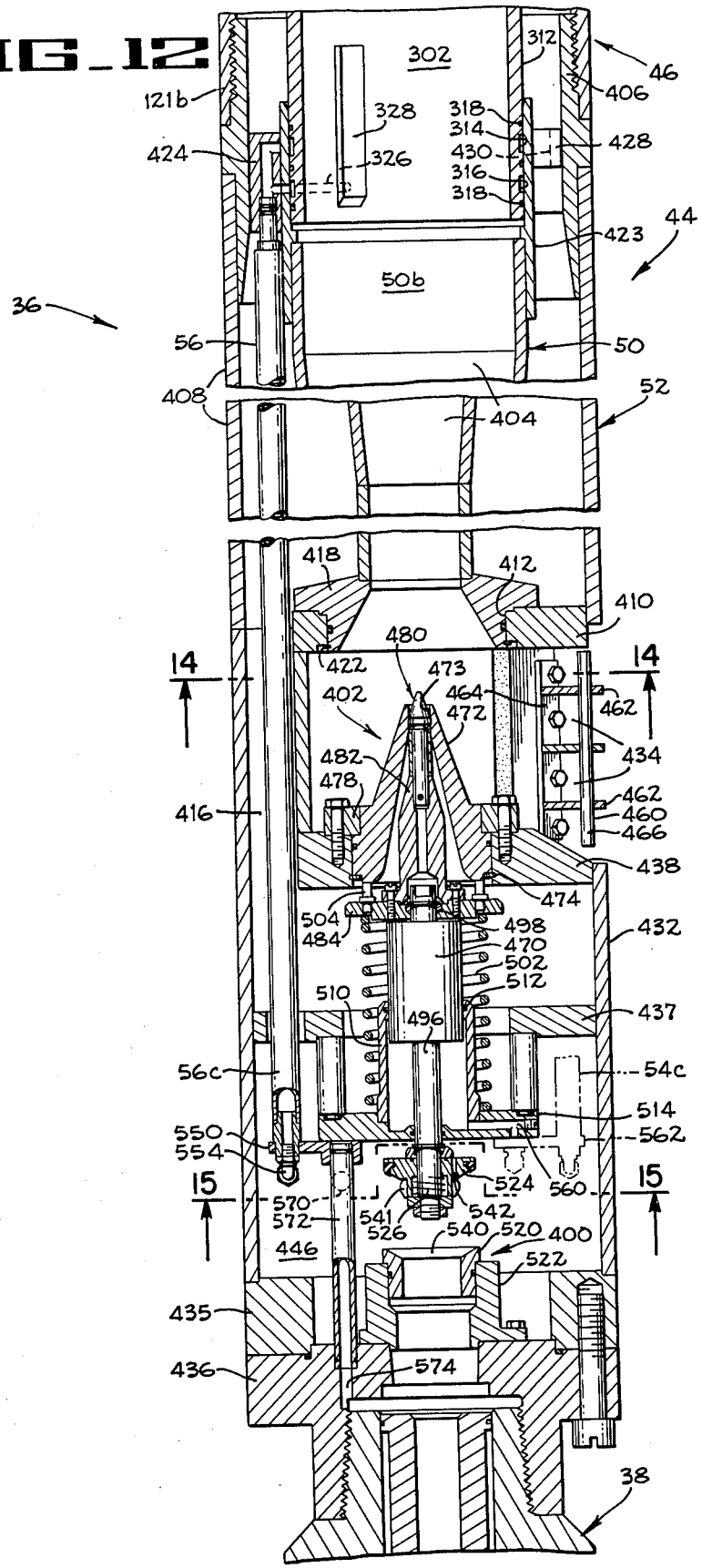
FIG. 12 is an enlarged vertical section taken along lines 12—12 of FIG. 13 of the eductor pump section shown coupled to an upper pipe section and to the drill bit with the parts in their drilling mode; the central portion of the venturi area of the pump being cut away to foreshorten the view, and a fragment of one of the control lines being shown out of its normal position in phantom lines.
Figure 13:
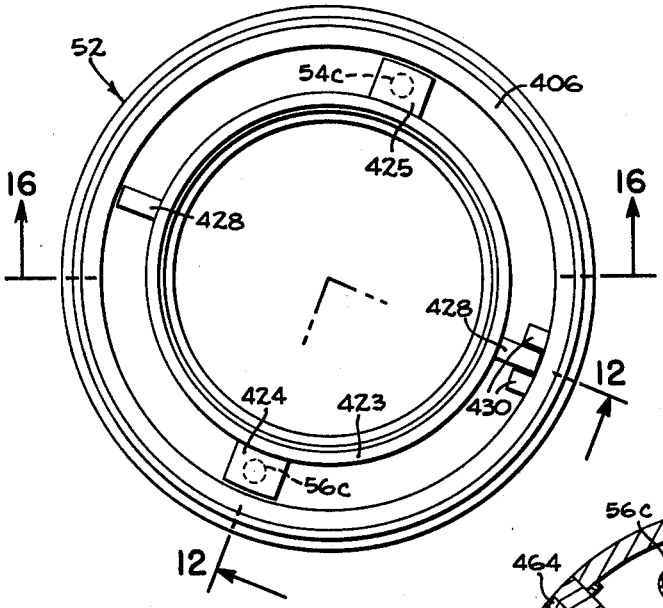
FIG. 13 is a plan of the eductor pump section, taken without the upper pipe section illustrating structure for centering and locking the upper portion of the inner pipe string from rotation relative to the upper portion of the string.

As best indicated in FIG. 12, which figure is a one-quarter section taken along lines 12—12 of FIG. 13, the lower box end 121*b*′ of the mining nozzle section 46 is screwed onto the upper externally threaded sleeve 406 of the eductor section 44. The sleeve 406 forms part of the outer conduit string 52 and is welded to a pipe section 408 that is in turn welded to a flange 410 which closes the bottom of the pipe section 408 except for a central aperture 412 (FIGS. 12 and 16) and a pair of diametrically opposed arcuate openings that cooperate with fabricated walls to define water inlet passages 414 and 416 that project downwardly below the eductor nozzle 402. A lower flange 418 of the venturi tube 404 is sealed in the central aperture 412 by an O-ring and a snap ring 422. The venturi tube 404 is shown partially cut away in FIG. 12 and is fabricated from several pipe sections of increasing diameter that are welded together and have an upper box end 423 which receives the pipe section 302 to define the outer portion of the previously described sealing gland 312. Connector housings 424 and 425 (FIGS. 12 and 13) and a pair of ears 428 welded to the box end 423 cooperate to maintain axial alignment of the venturi tube 404 with the outer string 52. One of the ears 428 is received between two guide blocks 430 to maintain the venturi tube 404 in proper angular relationship with the outer string components.

Figure 14:
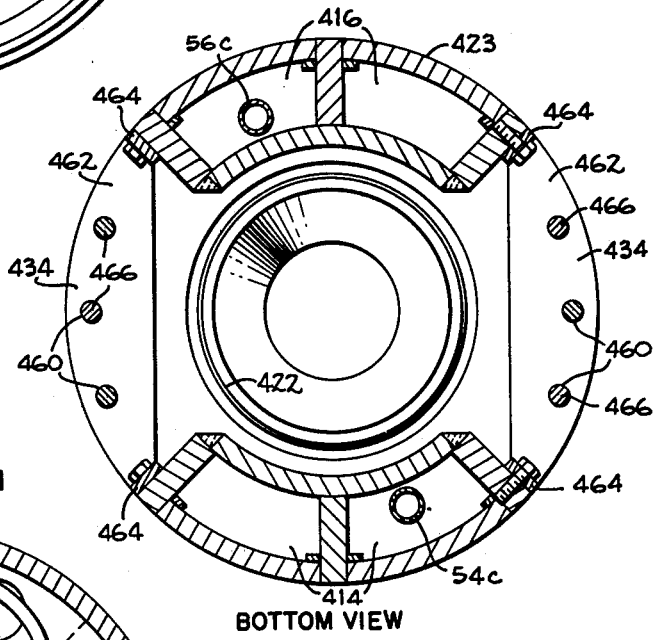
FIG. 14 is a horizontal section taken along lines 14—14 of FIG. 12 illustrating the structure for separating the water and slurry flow passages and also illustrating the guard for the mining flow inlet.

A short outer pipe section 432, a portion of which is fabricated as indicated in FIG. 14, includes a pair of diagrammatically opposed slurry inlet openings 434 and is welded to the pipe section 408 and to an annular flange 435 at its lower end. The aforementioned drill bit 38 is screwed into an adapter 436 that is bolted to the annular flange 435. A perforated cylinder supporting annulus 437 is welded within and extends across the pipe section 432 for supporting components to be described later, and also for permitting water to flow therepast. An eductor nozzle flange 438 is welded to the pipe section 432 at the lower edge of the slurry openings 434 and is centrally apertured to receive the eductor nozzle 402. The flange 438 is also provided with arcuate water passages 414*a* and 416*a* (FIG. 15 which form a portion of the arcuate passages 414 and 416, respectively. The fabricated inlet passages 414 and 416 are formed by walls of sufficient strength to transmit the necessary drilling torque to the drill bit 38 therebelow. The arcuate conduits 414, 416 direct all of the water downwardly past the closed eductor nozzle 402 and through the open foot valve 400 and drill bit 38 during drilling without any of the water passing out of the slurry inlet openings 434. Similarly, during mining all of the water moves downwardly past the eductor nozzle 402 into a chamber 446 between the nozzles 402 and the closed foot valve 400. Thereafter, most of the water is blocked by the closed foot valve 400 and rapidly flows upwardly through the open eductor nozzle 402 and venturi tube 404 to create suction which draws the slurry through the slurry inlet openings 434 for jet pumping to the surface.

In order to prevent large pieces of ore, rocks or other material from entering the tool string 36, eductor grilles 460 (FIGS. 12, 14 and 16) are bolted in each slurry inlet opening 434. Each grille 460 includes a series of spaced horizontal plates 462 welded at their ends to mounting bars 464. A series of vertical rods 466 are received in holes in the plates 462 and are welded thereto thus defining grilles which as illustrated have entrance openings of about 2½ inches × 2½ inches but may be as large as about 4 inches × 4 inches if desired.

Figure 16:
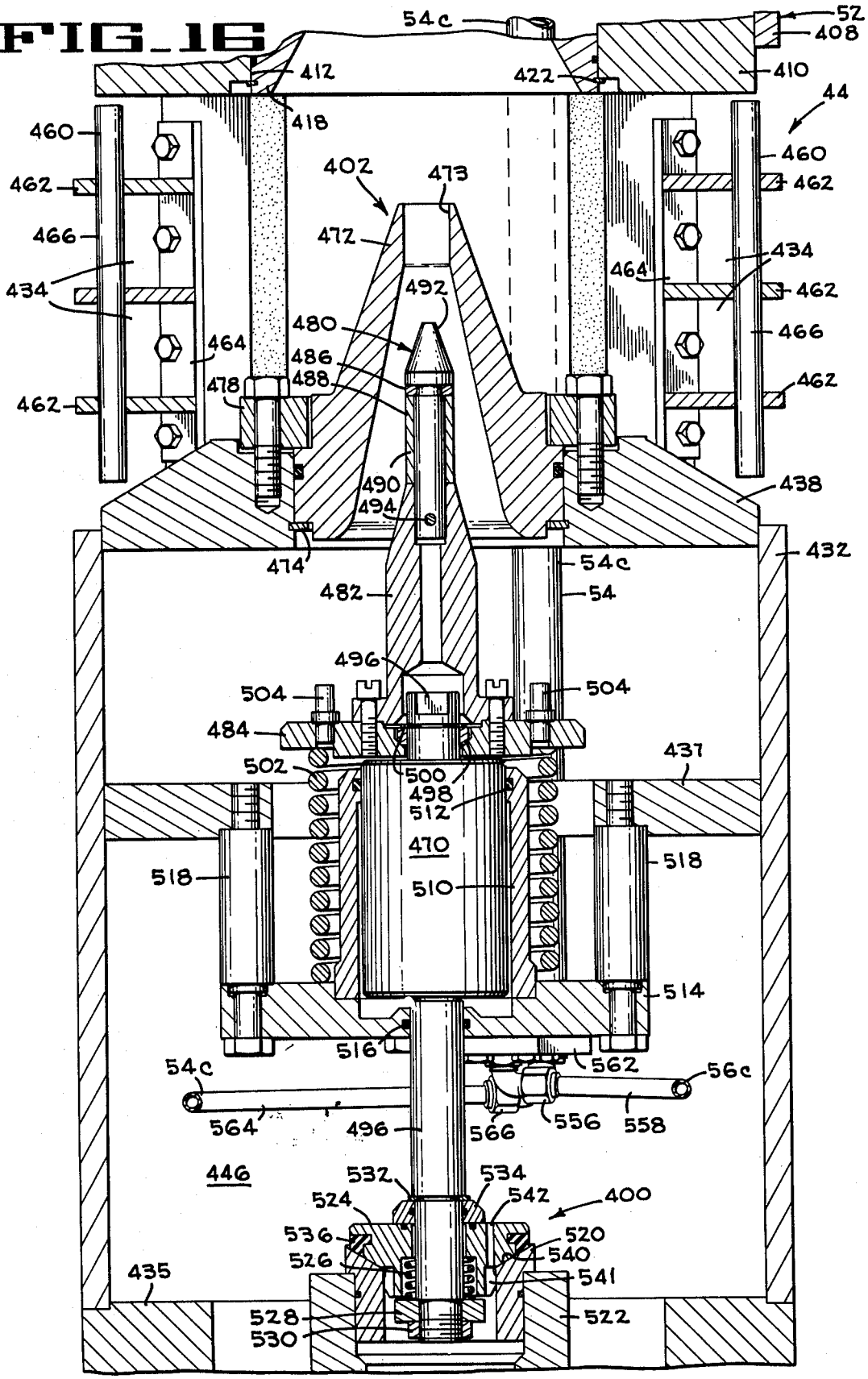
FIG. 16 is an enlarged vertical section taken along lines 16—16 of FIG. 13 showing the eductor nozzle and foot valve positioned in their mining mode.

As illustrated in FIGS. 12 and 16, the eductor nozzle 402 and foot valve 400 are operatively interconnected by a piston 470 which is effective to open the foot valve when the eductor nozzle is closed, and to close the foot valve when the eductor nozzle is open. The eductor nozzle 402 comprises a frusto-conical apertured nozzle seat 472 having an elongated cylindrical port 473. The seat 472 is secured in fluid tight engagement in the central opening of the flange 438 by a snap ring 474, an O-ring seal and a hold-down ring 478 bolted to the flange 438.

Since the nozzle 402 must be closed during drilling and is subjected to considerable wear due to high velocity water passing therethrough during mining, a nozzle plug 480 (FIG. 16) is provided with a removable sealing portion and is also shiftably mounted so that it may enter and seal the rather long cylindrical nozzle port 473 without binding.

The nozzle plug 480 includes a flanged tubular body 482 that is bolted to a centrally apertured spring retaining disc 484 and projects upwardly therefrom. A seal ring 486 and sleeve 488 are fitted around a nozzle stem 490 having an enlarged frusto-conical head 492 at its upper end. The stem 490 is rigidly secured in the tubular body 482 by a pin 494. The nozzle plug 480 is actuated by the piston 470 which includes a piston rod 496 projecting out both ends thereof. The upper end of the piston rod is loosely received in the aperture in the spring retaining disc 484. The aperture has a frusto-conical upper surface which mates with the frusto-conical lower surface of a ring 498 that is held on the piston rod 496 by a snap ring 500. It will be noted that a spring 502 urges the disc 484 upwardly away from the piston 470 thus permitting pivotal and/or transverse movement of the nozzle plug 480 relative to the frusto-conical seat of the ring 498. Upward movement of the nozzle plug 480 is limited by a plurality of shouldered pins 504 which abut against the nozzle seat 472.

The piston 470 is received in a cylinder 510 and is sealed thereto by an O-ring 512. The lower end of the cylinder 510 is closed by an apertured disc 514 which slidably receives the lower portion of the piston rod 496 and is sealed by an O-ring 516. The disc 514 supports one end of the spring 502 and is rigidly secured to the aforementioned cylinder supporting annulus 437 by a plurality of tubular spacers 518 and capscrews extending therethrough.

The foot valve 400 includes a seat 520 which is sealed to and seated within an annular flange 522 bolted to the drill bit adapter 436 (FIG. 12). A foot valve plug 524 is loosely received on the lower end portion of the piston rod 496 and is counterbored to receive a compression spring 526, (FIG. 16) which bears against a ring 528 secured to the piston rod 496 by a nut 530. Upward movement of the plug 524 is limited by a snap ring 532 and a collar 534 that is sealed to the piston rod and to the upper surface of the plug 524 by O-rings.

The foot valve plug 524 and a resilient seal ring 536 therein have frusto-conical sealing surfaces which mate with a frusto-conical sealing surface 540 of the seat 520 when the valve is closed. Centering vanes 541 enter the bore in the valve seat 520 and, unless perfectly aligned, cause transverse forces to center the resiliently loaded and loosely fitted foot valve plug 524 by shifting the plug transversely on the piston rod into axial alignment with the seat 520 thus providing a positive seal between the frusto-conical surfaces when the foot valve is closed. However, it is desirable to direct a certain amount of water through the drill bit 38 during mining to prevent the bit from becoming bound within the drill hole. Accordingly, at least one small diameter bleed passage 542 is drilled through the plug 524 to permit the desired amount of water to enter and flow through the drill bit without injury to the foot valve sealing surfaces as would occur if the foot valve were partially opened to accommodate such flow.

Figure 15:
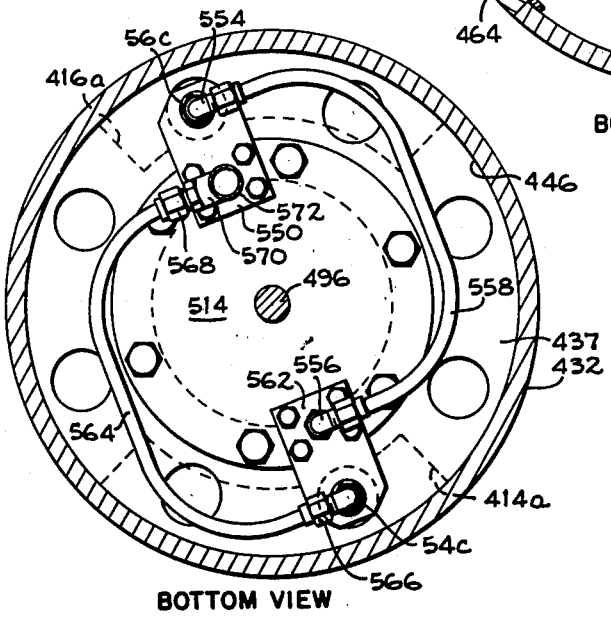
FIG. 15 is a horizontal section taken along lines 15—15 of FIG. 12 illustrating certain conduit connections for sensor/control lines used for controlling the operation of an eductor nozzle, the drill bit foot valve, and a mining nozzle.

As indicated in FIGS. 12 and 15, the operation of the eductor valve 402 and foot valve 400 is controlled by the fluid pressure in the chamber 446 which acts outside of the cylinder 510 relative to the pressure within the cylinder 510. The pressure within the cylinder is controlled by the control line 56 which includes conduit section **56*c* (FIGS. 12 and 15) that has its lower end fitted in an aperture in a bracket 550. The bracket 550 is bolted to the disc 514 and the conduit section 56*c* is secured thereto by a snap ring or the like. A pair of elbows 554 and 556 and a section of tubing 558 connect the conduit section 56*c* to a passage 560 leading into the cylinder 510. The elbow 556 is screwed into a bracket 562 that is bolted to disc 514 and is apertured to receive the lower end of the control line section 54*c* of the second or cavity pressure sensing control line 54. A section of tubing 564 (FIG. 15) and a pair of connectors 566, 568 connect a control line section 54*c* to a T-section 570 of a cavity pressure sensing tube 572 (FIGS. 12 and 15). The tube 572 is sealed by O-rings to a closed bore in the bracket 550 and a bore 574 in the drill bit adapter 436 which communicates with the interior of the drill bit 38**.

The force applied by the spring 502 is sufficient to maintain the eductor nozzle 402 closed and the foot valve 400 open when little or no liquid is in the eductor pump section 44 thereby preventing infiltration of sand or the like into the chamber 446 above the foot valve 400. The spring force is designed to allow the parts to shift to the positions illustrated in FIG. 16 at a low unbalanced supply pressure in the chamber 446 of about 60 psig.

During drilling, however, the control line 56 and cylinders 510 are subjected to the same drilling pressure (about 300 psig) as the pressure in chamber 446 thus overbalancing the hydraulic forces thereby maintaining the eductor nozzle 402 closed and the foot valve 400 open. The hydraulic force tending to open the eductor nozzle 402 is "overbalanced" because the opening force acting on the portion of the nozzle plug 480 within the cylindrical port 473 is subjected only to cavity pressure, not system pressure. The drilling fluid then passes through the drill bit 38 and washes the cuttings to the surface externally of the tool string 36. After the several components of the drilling and mining apparatus 30 have been assembled into the mining mode, control line 56 is vented to the surface and mining water is directed into the tool 36 through the annular passage between the inner and outer conduit strings 50, 52. When the unbalanced pressure reaches about 50 psig. the eductor nozzle 402 opens and the foot valve 400 closes. After closing the foot valve, the substantial area of the upper surface of the foot valve plug 524 will sense the mining or system pressure thus maintaining the foot valve closed since the cavity pressure below the foot valve is much lower during mining. During closing of the foot valve, the restriction in the control line 56 damps the rate of movement of the plug 524 thus precluding any significant water hammer damage.

After the system pressure has built up to about 100 psig the mining nozzle 46*a* (FIG. 7) is opened as previously described to commence breaking up the ore from the particular strata being mined. With a mining pressure of about 700 to 1000 psig., the jet of water from the mining nozzle breaks up the ore matrix into a slurry, which slurry is drawn through the slurry openings 434 (FIG. 16) and is pumped to the surface by the high velocity liquid flowing through the eductor nozzle 402. As previously indicated, the tool string is intermittently rotated during mining.

If it is desired to pump slurry to the surface with the mining nozzle 46*a* closed, the control pressure in line 56 is increased to the mining or system pressure thus closing mining nozzle 46*a*. The high control pressure will not, however, permit opening of the foot valve 400 (and closing of the nozzle 402) because of the aforementioned large upper and lower surfaces of the foot valve plug 524 and the much greater pressure acting on the upper surface.

If it is desired to mine ore from another strata, the water supply is cut off thereby closing the mining nozzle 46*a* and the eductor nozzle 402, the upper portion of the drilling and mining apparatus 30 is disassembled and new sections are added as the apparatus is drilled deeper until the eductor pump section 44 and mining nozzle 46*a* are properly aligned with the new strata to be mined. The apparatus 30 is thereafter reassembled into its mining mode and the above described mining operation is repeated for the new strata being mined. It will be understood that if slight height variations are deemed desirable during mining of a strata, that the entire apparatus may be raised by the cable hoist 72 (FIG. 1). It will also be understood that the well may be initially drilled to its lowest strata and after mining that strata the apparatus may be raised and disassembled section by section so that one or more higher ore matrixes can be mined after reassembly of the apparatus into its mining mode.

ROTARY DRILL BIT 38

The rotary drill bit 38 (FIG. 2) may be of any well known type which includes lower cutters 40 and pivotal side cutters or underreamers 42 that collapse within the body of the bit when the tool is being lifted from the well. A suitable underreamer is manufactured by Servco, P.O. Box 20212, Long Beach, CA and is known as the Servco Series 15000 Rock Type Underreamer. The underreamer is connected to the lower cutters 40 which are of the type manufactured by Hughes Tool Company,

ALTERNATE TOOL STRING ROTATING DEVICE 610

As mentioned previously, the tool string 36 (FIGS. 1 and 2) is rotated or indexed approximately 15° every 5 minutes by the torque wrench 76 (FIGS. 3 and 4) thereby causing the jet of water from the mining nozzle 46*a* to contact different areas of the ore matrix being mined. Also, as mentioned previously, the repeated engagement and disengagement of the jaws of the torque wrench 76 with the sleeve 144 (FIG. 6) of the mining head 60 damages the outer surface of the sleeve thus requiring occasional replacement of the sleeve.

Figure 17:
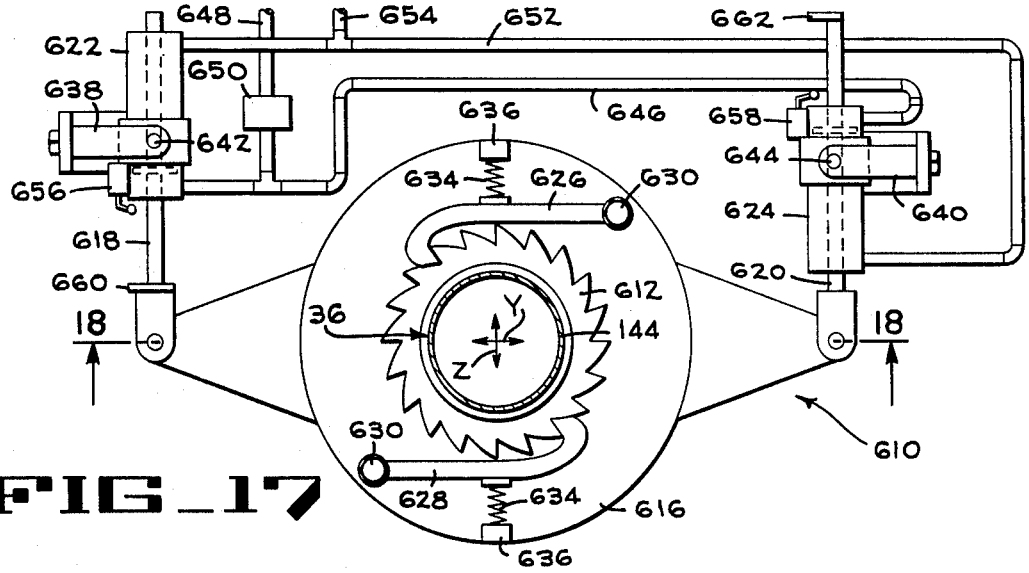
FIG. 17 is a horizontal section taken at the plane indicated by lines 17—17 of FIG. 2, illustrating an alternate ratchet drive for rotating the tool string during mining.
Figure 18:
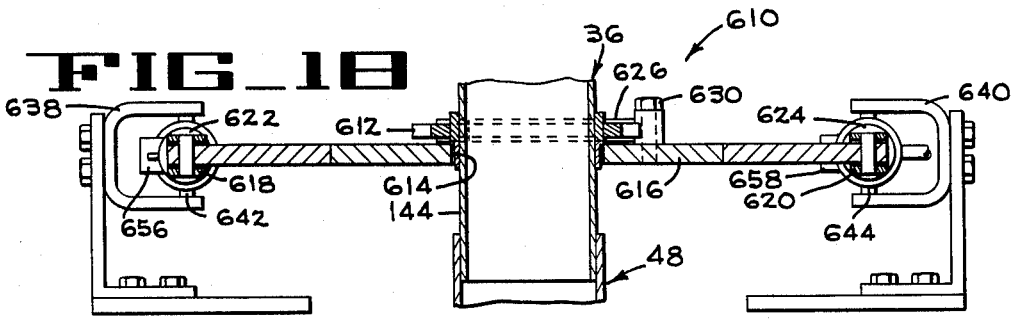
FIG. 18 is a section taken along lines 18—18 of FIG. 17 transversely of the barge.

An alternate tool string rotating device 610 (FIGS. 17 and 18) comprises a ratchet gear 612 which is welded or splined to the sleeve 144 of the mining head 60. When the mining head 60 is to be assembled on the uppermost pipe section, the sleeve 144 is first lowered through a clearance hole 614 in disc 616 having a pair of ears projecting outwardly therefrom and pivotally connected to the piston rods 618, 620 of hydraulic cylinder 622 and 624, respectively. A pair of ratchet pawls 626 and 628 are pivoted to the disc 616 by shouldered cap screw 630 and are urged into engagement with the teeth 632 of the ratchet 612 by compression spring 634 disposed between the associated pawls and blocks 636 welded to the disc 616.

A pair of trunnions 638 and 640 are rigidly secured to the previously described carriage 221 (FIG. 3) and support the hydraulic cylinders 622 and 624, respectively, for pivotal movement about the axes of pivot pins 642 and 644, respectively. The high pressure or driving ends of the hydraulic cylinders 622 and 624 are interconnected by a conduit 646 which is connected by a main conduit 648, having a solenoid valve 650 therein, to a hydraulic system (not shown). Similarly, a second conduit 652 connects the other ends of the cylinders 622 and 624 together into a second main conduit 654 of the hydraulic system. Thus, slight transverse misalignment of the barge relative to the tool string 36 as indicated by the arrows Y (FIG. 17) is compensated for by pivotal movement about pivot pins 642 and 644. Longitudinal misalignment as indicated by the arrows Z is compensated for by different amounts of retraction and extension, respectively, of the piston rods 618, 620 during the power stroke which occurs because equal pressure will be applied to both piston rods since they are interconnected by conduit 646. Because the strokes of the two piston rods 618 and 620 will not be the same when compensating for misalignment in the direction of arrow Z, and because very high side loads will result if one piston bottoms before the other, the power to both cylinders must be shut off by closing the solenoid valve 650 when the first piston bottoms out. To close the valve 650, limit switches 656 and 658 are mounted on the cylinders 622 and 624, respectively, and are positioned to engage stops 660 and 662 secured to the piston rod 618 and 620, respectively. The switches 656 and 658 are connected in parallel between an electrical power source and the solenoid valve 650. Therefore, the first switch to engage its stop will close the valve 650 thereby completing the indexing of the tool string. Low pressure may be directed through the conduit 654, 652 to the other ends of the cylinders to return the piston rods 618 and 620 to their starting positions illustrated in FIG. 17.

If it is desired to change the angular degree of rotation of the tool strings, the position of the stops 660. 662 on the piston rods may be adjusted. It will also be understood that the misalignment between the tool strings 36 and the barge 32 in a direction longitudinally of the barge as indicated by arrow Z (FIG. 1) may be partially compensated for by placing the piston rod 227 (FIG. 3) of the hydraulic cylinder 226 which operates the carriage 221 in the free moving neutral position.

OPERATION

Although the operation of the several components of the drilling and mining apparatus 30 (FIGS. 1 and 2) has been included in the detailed description of the component, a summary of the operation of the first embodiment of the invention will follow having reference primarily to FIGS. 1, 2 and 19.

The barge 32 is first moved to the mining site and is anchored in desired position and the conductor pipe 37 is driving into the bottom of the pond 34. The well drilling rig 35 is then used in conjunction with the drill loading unit 74, the torque wrench 76, and the tool slip 78 to assemble the apparatus 30 section by section while drilling the hole or well. During the drilling and assembly operation, the mining head 60 is stored on the deck, and the drilling head 64 is screwed into the upper end of each section of the tool string 36 to thread the outer conduit section 52 together while causing the non-rotatable inner sections 50 to move axially into sealing engagement with each other. The power swivel 66 provides the initial torque required to screw the eductor section 44, the mining section 46 and the plurality of double string pipe sections 48 together. Final high torque tightening of the threads interconnecting each section is provided by the torque wrench 76. After each section is firmly secured to the next lower section, the power swivel 66 acts through the mining head 64 to rotate the drill bit 38 thus drilling the hole.

During drilling after each section of the tool string 36 has been assembled, water at a surface pressure of about 300 psig is directed through the power swivel 66, the drilling head 64 (FIG. 2) and the annular passage between the outer conduit 52 and the inner conduit 50. At this time control conduits 54 and 56 are open to the drilling pressure, as indicated in FIG. 6, thus preventing the drilling water from flowing through both the eductor nozzle 402 and the mining nozzle 46*a* (FIG. 19).

The several pipe sections 48 vary in length between about 10 and 20 feet and are so selected that after assembly of the last pipe section 48 on the tool string 36, mining nozzle 46*a* and the eductor pump 44 are positioned in the ore bearing strata or matrix to be mined as indicated in FIG. 2. The mining head 60 is then moved by a crane into position to be received and supported by the drilling head 64. The power swivel 66 then screws the drilling head 64 into the mining head 60 and the mining head 60 into the uppermost pipe section 48. The shear pin 140 (FIG. 6) between the upper portion of the mining head 60 and its swivel joint 58 is then removed and the torque arm 137 is pivoted to its solid line position against a leg of the drill rig 35 to hold the upper portion of the mining head from rotation. The water inlet conduit 130 and slurry outlet conduit 132, which conduits preferably include long flexible portions (not shown), are then connected to the mining head 60 thus placing the apparatus in its mining mode of operation.

During mining, the hoist 72, power swivel 66 and drilling head 64 which is screwed into the mining head 60 supports the entire apparatus 30 without the aid of the tool slip 78. During mining, the torque wrench 76 (or the alternate tool string rotating device 610 FIG. 17) intermittently indexes or rotates the string below the swivel joint 58 at a rate determined to be most suitable for the particular type of ore strata being mined. For example, it has been determined that rotation of about 15° every five minutes has been found desirable for certain ore bearing strata which is of sandy consistency. During this time the structure for mounting the torque wrench 76 (or alternate device 610) will compensate for misalignment between the tool string 36 and the barge 32. If helpful to dislodge the ore from the matrix being mined, the hoist 72 may also be used to raise or lower the entire tool string several feed during mining to more effectively direct the jet of water from the mining nozzle 46*a* against the ore matrix to reduce the ore to a slurry.

In order to control the opening and closing of the mining nozzle 46*a*, the eductor nozzle 402, and the foot valve 400, the control system 57 (FIG. 19) is employed. The nozzles 46*a* and 402 are held closed and the foot valve is held open by springs 380,502 when no water pressure is applied to the tool string 36 or to the control system 57. When equal water pressure is applied to the control system 57 and to the tool string 36 as occurs during drilling, the mining nozzle 46*a* and the eductor nozzle 402 are likewise held closed and the foot valve is held open by the springs 380,502 and the "overbalanced" hydraulic control pressure acting on the two nozzles as previously described. During mining, control lines 56 and 54 are vented to the atmosphere and to cavity pressure, respectively. Control line 56 is vented by opening the valve 136*a* to the atmosphere and, if desired, line 54 is connected to a metered supply of high pressure air. With valve 136*a* vented, water is initially directed into the outer conduit section 52 by the pump P (FIG. 1) at a pressure in excess of about 100 psig. This system pressure exceeds the spring pressure thus opening the mining nozzle 46*a* and the eductor nozzle 402, and closing the foot valve 400. The pump P then increases the system pressure to about 700 to 1000 psig at which time the jet of water discharged from the mining nozzle 46*a* reduces a portion of the ore in the matrix being mined to a slurry. Water flowing upwardly through the eductor nozzle 46 and the venturi tube 404 then lifts the slurry to the surface for discharge out of the opening 132 (FIG. 6) and into any suitable collecting means not shown.

If it is desired to close the mining nozzle 46*a* during mining in order to lower the water level in the cavity within the matrix being mined below the level of the nozzle 46*a*, or for increasing the pumping capability of the eductor pump, the system pressure is first reduced to minimize the water hammer effect by partially closing valve 131 (FIG. 1) or by otherwise reducing the output pressure of the pump P. The valve 136*a* (FIG. 19) is then opened to system pressure thus directing full system pressure into the mining nozzle cylinder 334 thereby closing the mining nozzle 46*a*. Mined pressure is therafter increased to about 1000 psig causing the flow of water through the eductor nozzle 402 to pump the slurry to the surface. The mining nozzle 46*a* may again be opened by first reducing the system pressure, thereafter opening valve 136*a* to the atmosphere, and then increasing the system pressure to its normal 700 to 1000 psig mining pressure.

Although full system pressure will also be directed into the eductor valve cylinder 510 when the mining nozzle is being closed as above described, it will be understood that the pressure action on the upper surface of the foot valve plug 524 is much greater than the cavity pressure acting on the lower surface of the closed foot valve plug thus the foot valve will remain closed and the eductor nozzle will remain open at this time.

When the ore within the range of the jet of water discharge from the mining nozzle has been depleted in the particular matrix being mined, the apparatus may be returned to its drilling mode and either drilled deeper or raised to another matrix level by adding or removing pipe sections without requiring that the entire apparatus be removed from the hole. Before changing from the mining to the drilling mode, the pump P (FIG. 1) is turned off, thus equalizing the pressure above and below the foot valve plug 524. Thus, the mining nozzle 46*a* and the eductor nozzle 402 will be closed by the force applied by the springs 380 and 502, and the foot valve 400 will be opened. The mining head 60 is then removed and the drilling head is screwed into a pipe section to be added or removed from the tool string 36. The pump is started and water at about 300 psig is directed into both control lines and the outer annular conduit 52 in the tool string 36 thus maintaining the nozzles closed during drilling. The nozzles 46*a* and 402 will remain in their closed positions during drilling because the control pressure plus spring force provides an adequate force to close the nozzles as previously described.

Figure 20:
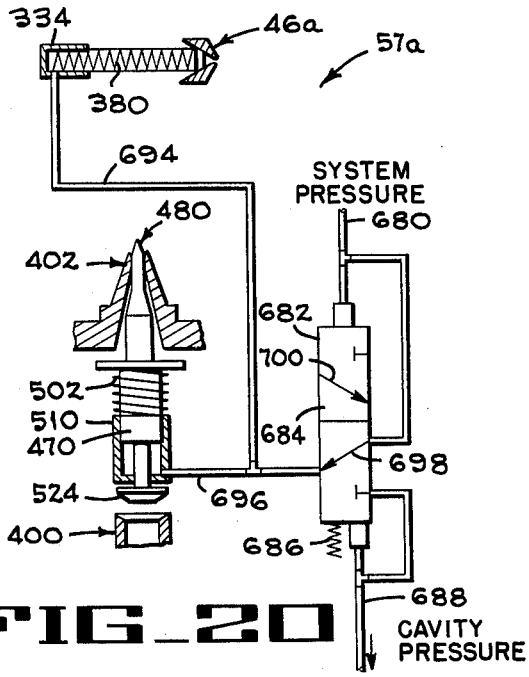
FIG. 20 is a schematic diagram illustating a modified control circuit which actuates the nozzles in accordance with variations of system pressure and without the aid of control lines to the surface.

FIG. 20 illustrates a modified, self activating control system 57*a*. The system 57*a* acts in response to variations in the system pressure and the detection of pressure differences between the system pressure and the cavity pressure. This self activating system, therefore, requires no control lines to the surface for operating the two nozzles and foot valves as above described.

As diagrammatically illustrated, the system includes a conduit 680 which has one end open to receive relatively clean mining water within the outer conduit 52 (FIG. 12) preferably at a point within the chamber 446 below the eductor nozzle 402 but above the foot valve 400. The conduit 680 communicates with one end of a valve 682 having a shiftable core 684 therein which is normally held in the illustrated nozzle closing position by a strong spring 686. A second conduit 688 establishes communication between the other end of the valve 682 and the well cavity at a point outside of the tool string 36 which is at a relatively low pressure during mining and drilling. The conduit 680 also communicates with conduits 694 and 696 leading to the mining nozzle cylinder 334 and the eductor nozzles cylinder 510, respectively, through a cross passage 698 in the valve core when the valve core is positioned as illustrated in FIG. 20. When the core 684 is in the illustrated position, system pressure is directed into the cylinders 334 and 510 thereby aiding the springs 380 and 502 to hold the mining nozzle 46*a* and the eductor nozzle 402 closed and the foot valve 400 open.

Although a drilling system pressure of about 300 psig is insufficient to overcome the force exerted by the spring 686, the 1000 psig mining pressure is sufficient to shift the valve core 684 downwardly against the urging of the spring. At this time, a second cross passage 700 in the core 684 establishes communication between the conduit 688 and the conduits 694 and 696 thus venting the cylinders 334 and 510 to the relatively low cavity pressure. The higher 700 to 1000 psig system pressure acting on the external surfaces of the mining nozzle 46*a* and the eductor nozzle 402 will then be sufficient to open the nozzles 56*a* and 402 and close the foot valve 400 thus placing these components of the mining and drilling apparatus 30 in their mining mode of operation.

A subsequent reduction of system pressure to about 300 psig will cause the spring 686 to return the parts to the position illustrated in FIG. 20 thus causing the 300 psig liquid pressure in the cylinder 334 to close the mining nozzles 46*a* with the aid of its spring 380. However, the eductor nozzle 402 will not close at this pressure since the 300 psig water which flows into the cylinder 510 is not sufficient to open the foot valve 400 because of the large area of the plug 524 and the substantial pressure differential acting on the upper and lower surfaces of the plug 524. Thus, the mining nozzle 46*a* may be opened or closed during mining by varying the system pressure between the 700 to 1000 psig mining pressure and the 300 psig drilling pressure.

When it is desired to return the apparatus 30 to its drilling mode, the pump P (FIG. 1) is stopped thus equalizing the pressure on both sides of the foot valve 400 allowing the springs 502 and 380 to open the foot valve 400 and close the eductor nozzle 402 and mining nozzles 46*a*. Thus, the drilling and mining apparatus 30 may be changed between the mining mode and the drilling mode without requiring that the entire apparatus be pulled out of the hole, and without requiring any control lines leading to the surface.

APPARATUS WITH TWO MINING NOZZLES

Figure 21:
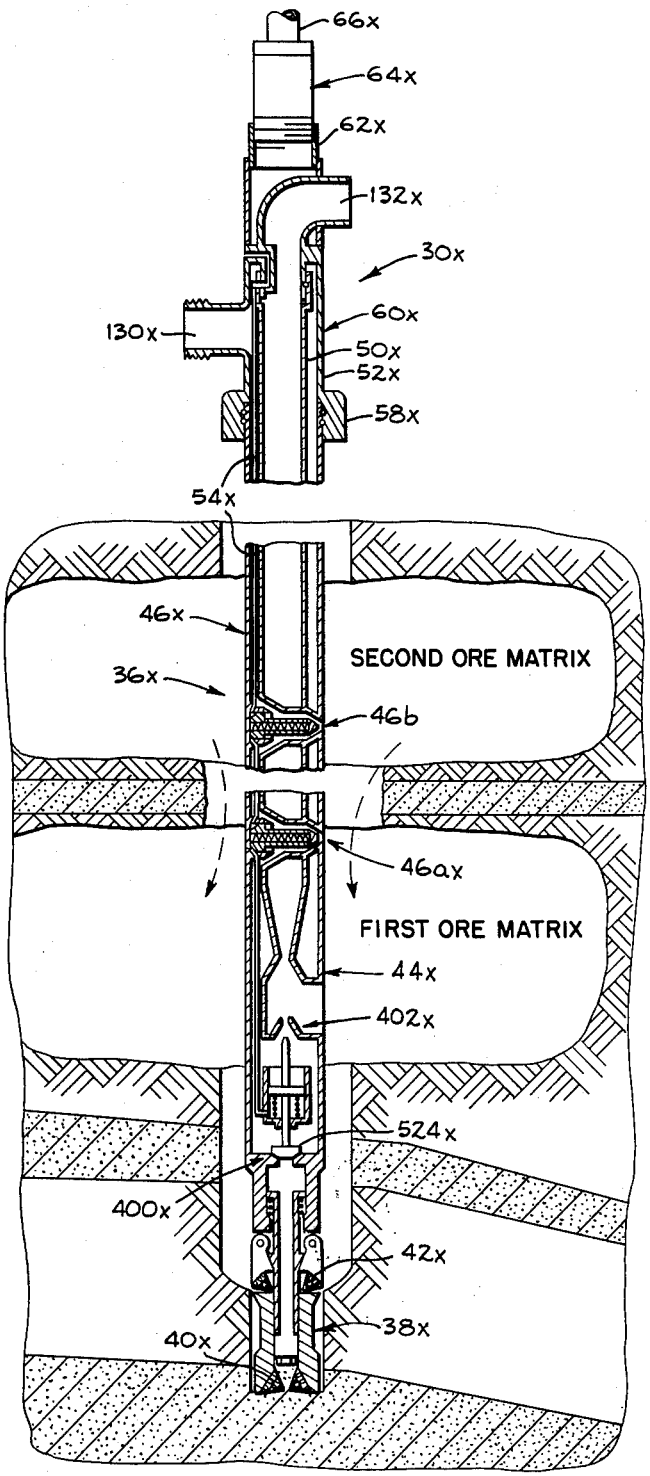
FIG. 21 is a diagrammatic vertical central section taken through a second embodiment of the invention which is substantially the same as that disclosed in FIG. 2 except two mining nozzles are illustrated.
Figure 22:
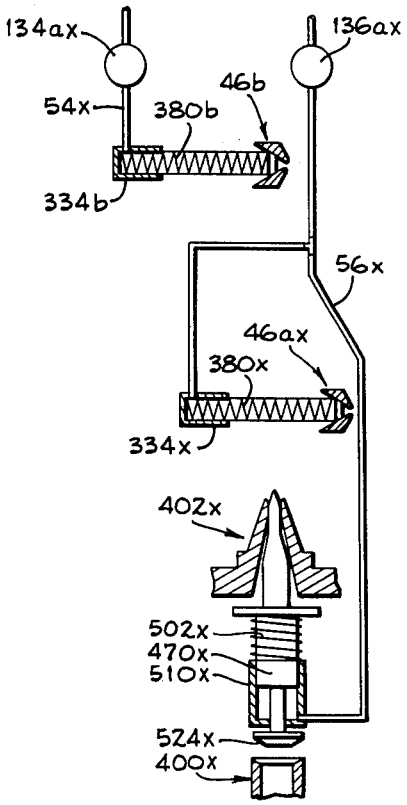
FIG. 22 is a schematic diagram similar to FIG. 19 for controlling the operation of the apparatus of FIG. 21.

The second embodiment of the invention illustrated in FIGS. 21 and 22 is substantially the same as the first embodiment of the invention except that it includes a second mining nozzle 46*b* oriented in a second ore matrix to be mined that is above the first ore matrix. Since the second mining nozzle is identical to the first mining nozzle, it will be described in detail. Also, since the other components of the two embodiments are substantially the same, equivalent parts of the second embodiment will be assigned the same numerals used to describe the first embodiment followed by the letter (*x*).

It will be understood that the second nozzle 46*b* is spaced from the first mining nozzle 46*ax* by tool string sections of the proper length so that the second nozzle 46*b* will be in an upper or second ore matrix when the first mining nozzle 46*ax* and the eductor pump section 44*x* are both in a lower or first matrix to be mined. It will also be noted that the slurry from the upper matrix will gravitate downwardly into the cavity formed in the lower matrix so that it can be drawn into the apparatus 30*x* and be pumped to the surface by the eductor pump section 44*x*. In this regard, if the two levels or matrixes being mined are spaced a substantial distance from each other, the slurry will gravitate downwardly in the space between the apparatus 30*x* and the inner surface of the well. If the two ore matrixes are close together, the overburden between the two layers is apt to collapse into the lower cavity with substantially all of the material being reduced to a slurry and pump to the surface.

The apparatus 30*x* with two mining nozzles is operated during drilling and mining is substantially the same manner discussed above in regard to the single mining nozzle system. Thus, only the differences in operation resulting from the addition of the second nozzle 46*b* will be described in detail. The cylinder 334*b* (FIG. 22) of the second mining nozzle 46*b* is connected to the control conduit 54*x* and may be controlled independently of the mining nozzle 46*ax* by operation of the valve 134*ax* between a position which vents conduit 54*x* to the atmosphere (or to the cavity) thereby permitting the mining nozzle 46*b* to open, and a position which directs system pressure into conduit 54*x* and cylinder 334*b* thereby holding mining nozzle 46*b* closed.

During mining, the mining nozzle 46*b* may be opened and closed without affecting the open eductor nozzle 402*x* or the closed foot valve 400*x* because of the application of high system pressure on the large upper surface and low cavity pressure on the lower surface of the foot valve plug 524*x* as previously explained in regard to the first embodiment of the invention.

When it is desired to open mining nozzle 46*b* and close mining nozzle 46*ax*, the valve 134*ax* is first closed to system pressure thus reducing the pressure in the cavity and in the cylinder 334*b* of mining nozzle 46*b* to cavity pressure. Thereafter, valve 136*ax* is opened to direct system pressure into the cylinder 334*x* and 510*x* thus closing mining nozzle 46*ax* but retaining foot valve 400*x* closed and eductor nozzle 402*x* open because of the differential pressure acting on the foot valve plug 524*x*.

When the water supply pump is turned off, the springs 380*b*,380*x* and 502*x* will close mining nozzles 46*b*, 46*ax* and eductor nozzle 402*x* and open foot valve 400*x* thus returning the system to its drilling mode.

From the foregoing description it will be apparent that it is within the scope of the present invention to provide a method of using a drilling and mining apparatus having either one mining nozzle or a plurality of mining nozzles. The mining nozzles reduce the ore to a slurry, and an eductor pump section pumps the slurry to the surface for collection. An interconnected foot valve and eductor nozzle in the eductor pump section, and the mining nozzle (or nozzles) are selectively controlled for movement between open and closed positions by hydraulic control systems responsive to pressures equal to or less than the system pressure. One of the control systems is operated by control lines leading to the surface, whereas another control system is devoid of control lines to the surface and is self-activated by differences between the cavity pressure and the system pressure within the apparatus as determined by control of the water supply entering the drilling and mining apparatus from the surface. During mining the entire tool string below a mining head swivel joint is intermittently rotated to direct a jet of water from the mining nozzle against different portions of the ore matrix being reduced to a slurry. During rotation, means are provided to minimize any unbalanced side loads on the tool string.

Although the best mode contemplated for carrying out the present invention has been herein shown and described, it will be apparent that modification and variation may be made without departing from what is regarded to be the subject matter of the invention.

I claim:

1. A method of drilling a hole into and mining ore from a subterranean deposit of granular ore with apparatus including a multi-section tool string having a drill bit on its lower end; and a mining nozzle, an eductor nozzle and a foot valve, each being movable between a drilling mode and a mining mode of operation comprising the steps of: alternately rotating and holding the outer portion of a multi-section tool string from rotation for screwing the outer portions together while assembling the string section-by-section, rotating and lowering the tool string while drilling a hole into the ore matrix to be mined, directing a substantial quantity of liquid during the drilling mode at system pressure through the foot valve into the hole for washing cuttings to the surface, closing the foot valve and opening the mining nozzle and eductor nozzle during the mining mode for terminating the major quantity of liquid flow into the bottom of the hole, splitting the liquid flow with a portion of the liquid being directed transversely of the tool string through the mining nozzle into the ore matrix to reduce the ore to a slurry and with another portion of the liquid directed upwardly through the eductor nozzle to pump the slurry to the surface, rotating the tool string during mining, and selectively controlling the opening and closing of the nozzles and foot valve while the tool string is in the hole by applying a control pressure equal to the system pressure during drilling for maintaining the mining nozzle and eductor nozzle closed and the foot valve open, and by applying a control pressure less than the system pressure during mining for opening the mining nozzle and eductor nozzle and closing the foot valve.

2. A method according to claim 1 wherein the control pressure during mining is established by venting to atmospheric pressure.

3. A method according to claim 1 wherein the control pressure during mining is established by venting to cavity pressure.

4. A method according to claim 3 wherein the system pressure during drilling is about 300 psig at the surface and wherein the system pressure during mining is between about 700 to 1000 psig at the surface.

5. A method according to claim 1 wherein a first hydraulic power means shifts the mining nozzle and a second hydraulic power means shifts both the eductor nozzle and the foot valve with the eductor nozzle being closed when the foot valve is open; and wherein the mining nozzle is modulated during mining between the open position and closed position without opening the foot valve by alternately varying the control pressure between a vented pressure and a system pressure.

6. A method according to claim 1 wherein a second mining nozzle is operated by a hydraulically actuated power means in the tool independent from the power means which actuates said first nozzle and disposed at an elevation different from that of the first mining nozzle, and wherein each of the mining nozzles is shifted from the drilling mode to the mining mode by venting the control pressure to the atmosphere.

7. A method according to claim 1 and further including the step of moving the tool string vertically during mining to change the elevation at which the liquid passing through the mining nozzle contacts the ore matrix.

8. In a method of drilling a hole into and mining ore from a subterranean deposit of granular ore with apparatus including a multi-section tool string having a drill bit on its lower end; and a mining nozzle and a foot valve intermediate the ends of the tool string with each being movable between a drilling mode and a mining mode of operation comprising the steps of: alternately rotating and holding the outer portion of a multi-section tool string from rotation for screwing the outer portions together while assembling the string section-by-section, rotating and lowering the tool string while drilling a hole into the ore matrix to be mined, directing a substantial quantity of liquid during the drilling mode at system pressure through the foot valve into the hole for washing cuttings to the surface, closing the foot valve and opening the mining nozzle during the mining mode for terminating the major quantity of liquid flow into the bottom of the hole, directing a high pressure stream of liquid transversely of the tool string through the mining nozzle into the ore matrix to reduce the ore to a slurry, rotating the tool string during mining, and selectively controlling the opening and closing of the mining nozzle and foot valve while the tool string is in the hole by applying a control pressure equal to the system pressure during drilling for maintaining the mining nozzle closed and the foot valve open, and by applying a control pressure less than the system pressure during mining for opening the mining nozzle and closing the foot valve.

9. A method according to claim 8 wherein the control pressure during mining is established by venting to atmospheric pressure.

10. A method according to claim 8 wherein the control pressure during mining is established by venting to cavity pressure.

11. A method according to claim 8 wherein the system pressure during drilling is about 300 psig at the surface and wherein the system pressure during mining is between about 700 to 1000 psig at the surface.

12. A method according to claim 8 wherein the mining nozzle is modulated during mining between the open position and closed position without opening the foot valve by alternately varying the control pressure between a vented pressure and a system pressure.

13. A method according to claim 8 wherein a second mining nozzle is operated by a hydraulically actuated power means in the tool independent from the power means which actuates said first nozzle and disposed at an elevation different from that of the first mining nozzle, and wherein each of the mining nozzles is shifted from the drilling mode to the mining mode by venting the control pressure to the atmosphere.

14. In a method of drilling a hole into and mining ore reduced to a slurry from a subterranean deposit of granular ore with apparatus including a multi-section tool string having a drill bit on its lower end; and an eductor nozzle and foot valve intermediate the ends of the tool string with each being movable between a drilling mode and a mining mode of operation comprising the steps of: alternately rotating and holding the outer portion of a multi-section tool string from rotation for screwing the outer portions together while assembling the string section-by-section, rotating and lowering the tool string while drilling a hole into the ore matrix to be mined, directing a substantial quantity of liquid during the drilling mode at system pressure through the foot valve into the hole for washing cuttings to the surface, closing the foot valve and opening the eductor nozzle during the mining mode for terminating the major quantity of liquid flow into the bottom of the hole, directing a flow of liquid upwardly through the eductor nozzle to pump the slurry to the surface, rotating the tool string during mining, and selectively controlling the opening and closing of the eductor nozzle and foot valve while the tool string is in the hole by applying a control pressure equal to the system pressure during drilling for maintaining the eductor nozzle closed and the foot valve open, and by applying a control pressure less than the system pressure during mining for opening the eductor nozzle and closing the foot valve.

15. A method according to claim 14 wherein the control pressure during mining is established by venting to atmospheric pressure.

16. A method according to claim 14 wherein the control pressure during mining is established by venting to cavity pressure.

17. A method according to claim 14 wherein the system pressure during drilling is about 300 psig at the surface and wherein the system pressure during mining is between about 700 to 1000 psig at the surface.

* * * * *

UNITED STATES PATENT AND TRADEMARK OFFICE

CERTIFICATE OF CORRECTION

PATENT NO. : 4,077,671

DATED : March 7, 1978

INVENTOR(S) : Philip R. Bunnelle

It is certified that error appears in the above-identified patent and that said Letters Patent are hereby corrected as shown below:

Column 4, line 20: after "drill" insert --bit--.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*